US010978813B2

(12) United States Patent
Yang et al.

(10) Patent No.: US 10,978,813 B2
(45) Date of Patent: Apr. 13, 2021

(54) BOWTIE ANTENNA ARRANGEMENT

(71) Applicant: Gapwaves AB, Gothenburg (SE)

(72) Inventors: Jian Yang, Mölndal (SE); Jungang Yin, Hunan (CN); Chao Xie, Hunan (CN); Sadegh Mansouri Moghaddam, Gothenburg (SE)

(73) Assignee: GAPWAVES AB, Gothenburg (SE)

( * ) Notice: Subject to any disclaimer, the term of this patent is extended or adjusted under 35 U.S.C. 154(b) by 0 days.

(21) Appl. No.: 16/485,965

(22) PCT Filed: Feb. 27, 2017

(86) PCT No.: PCT/SE2017/050184
§ 371 (c)(1),
(2) Date: Aug. 14, 2019

(87) PCT Pub. No.: WO2018/156063
PCT Pub. Date: Aug. 30, 2018

(65) Prior Publication Data
US 2020/0059010 A1 Feb. 20, 2020

(51) Int. Cl.
*H01Q 9/28* (2006.01)
*H01Q 21/06* (2006.01)
(Continued)

(52) U.S. Cl.
CPC ..... *H01Q 21/065* (2013.01); *H01Q 1/48* (2013.01); *H01Q 5/25* (2015.01); *H01Q 9/28* (2013.01);
(Continued)

(58) Field of Classification Search
CPC ..... H01Q 21/065; H01Q 1/48; H01Q 9/28; H01Q 21/0087; H01Q 21/062;
(Continued)

(56) References Cited

U.S. PATENT DOCUMENTS 8,325,093 B2 * 12/2012 Holland ..... H01Q 9/285 343/700 MS
9,172,147 B1 * 10/2015 Manry, Jr. ..... H01Q 15/0086
(Continued)

FOREIGN PATENT DOCUMENTS

CN 102394349 A 3/2012
CN 103503231 A 1/2014
(Continued)

OTHER PUBLICATIONS

Chao Xie, et al., "An Ultrawideband Dipole With a Director as a Feed for Reflector Antennas", IEEE Antennas and Wireless Propagation Letters, vol. 16, pp. 1341-1344, 2017.
(Continued)

*Primary Examiner* — Vibol Tan
(74) *Attorney, Agent, or Firm* — Buchanan Ingersoll & Rooney P.C.

(57) ABSTRACT

A bowtie antenna arrangement including at least one bowtie structure including bowtie arm sections made of an electrically conducting material with each an end portion facing an end portion of another bowtie arm section, a base portion including a conducting ground plane, the bowtie structure being connected to a feeding arrangement. The bowtie arm sections are planar, made of a conducting sheet or plate element and are arranged in a bowtie arm section plane located in parallel with, at a first distance from a first side of the base portion, the, or each, bowtie arm structure being connected to a feeding port on a second side of the base portion.

28 Claims, 29 Drawing Sheets

(51) Int. Cl.
*H01Q 1/48* (2006.01)
*H01Q 21/00* (2006.01)
*H01Q 5/25* (2015.01)

(52) U.S. Cl.
CPC ..... *H01Q 9/285* (2013.01); *H01Q 21/0087* (2013.01); *H01Q 21/062* (2013.01)

(58) Field of Classification Search
CPC .. H01Q 5/378; H01Q 25/001; H01Q 21/0093; H01Q 19/24; H01Q 21/24; H01Q 9/285; H01Q 1/246; H01Q 9/0407; H01Q 9/065; H01Q 5/25; H01Q 5/42; H01Q 5/48; H01Q 5/50; H01Q 5/385; H01Q 5/392
See application file for complete search history.

(56) References Cited

U.S. PATENT DOCUMENTS

| | | | | |
|---|---|---|---|---|
| 9,748,657 | B1 * | 8/2017 | Grimsrud | H01Q 9/16 |
| 9,843,108 | B2 * | 12/2017 | Le | H01Q 21/062 |
| 9,935,373 | B2 * | 4/2018 | Yang | H01Q 21/0087 |
| 10,498,017 | B2 * | 12/2019 | Ouedraogo | H01Q 21/26 |
| 10,741,914 | B2 * | 8/2020 | Vouvakis | H01Q 21/062 |
| 2012/0280879 | A1 | 11/2012 | Zimmerman et al. | |
| 2016/0028166 | A1 | 1/2016 | Le et al. | |
| 2018/0040955 | A1 * | 2/2018 | Vouvakis | H01Q 5/42 |

FOREIGN PATENT DOCUMENTS

| | | | |
|---|---|---|---|
| CN | 104733844 | A | 3/2015 |
| WO | 2012/151210 | A1 | 11/2012 |
| WO | 2014062112 | A1 | 4/2014 |
| WO | 2016/011977 | A1 | 1/2016 |
| WO | 2016044208 | A1 | 3/2016 |
| WO | 2016138267 | A1 | 9/2016 |

OTHER PUBLICATIONS

International Search Report (PCT/ISA/210) dated Oct. 26, 2017, by the European Patent Office as the International Searching Authority for International Application No. PCT/SE2017/050184.
Written Opinion (PCT/ISA/237) dated Oct. 26, 2017, by the European Patent Office as the International Searching Authority for International Application No. PCT/SE2017/050184.
Office Action (The First Office Action) dated Jun. 29, 2020, by the State Intellectual Property Office of the People's Republic of China in corresponding Chinese Patent Application No. 201780086981.8, and an English Translation of the Office Action. (26 pages).
Office Action (Notification of Reason for Rejection) dated Dec. 15, 2020, by the Japanese Patent Office in corresponding Japanese Patent Application No. 2019-545778, and an English Translation of the Office Action. (9 pages).

* cited by examiner

BOWTIE ANTENNA ARRANGEMENT

TECHNICAL FIELD

The present invention relates to a bowtie antenna arrangement having the features of the first part of claim 1.

BACKGROUND

There is an increasing demand for wideband antennas for use within for example wireless communication in order to allow communication in several frequency bands, the use of high or very high data rates and for different systems. Ultra-Wide Band (UWB) signals are generally defined as signals having a large relative bandwidth (bandwidth divided by carrier frequency) or a large absolute bandwidth. More generally, UWB technology is attractive for many different applications in different areas, such as in sensor networks, short-range communication systems, UWB radar and imaging systems, radio astronomy, UWB surveillance and measurements systems. This has led to the development of several new UWB antenna technologies. In addition, several high frequency applications, e.g. involving millimeter wave frequencies (30-300 GHz), will be used within different areas, for example 5G communication systems and car radar systems.

Use of wideband signals has for example been described in "History and applications of UWB", y M. Z. Win et. al, Proceedings of the IEEE, vol. 97, No. 2, p. 198-204, February 2009.

UWB-technology has for some time been known as a low cost technology. Development of CMOS processors transmitting and receiving UWB-signals opened up for a large field of different applications and they can be fabricated at a very low cost for UWB-signals without requiring any hardware for mixers, RF (Radio Frequency)-oscillators or PLLs (Phase Locked Loops).

UWB technology can be implemented in a wide range of areas, for different applications, such as for example short range communication (less than 10 m) with very high data rates (up to or above 500 Mbps), e.g. for wireless USB similar communication between components in entertainment systems such as DVD players, TV and similar; in sensor networks where low data rate communication is combined with precise ranging and geolocation, and radar systems with extremely high spatial resolution and obstacle penetration capabilities, and generally for wireless communication devices.

To generate, transmit, receive and process UWB signals, the development of new techniques and arrangements within the fields of generation of signals, signal transmission, signal propagation, signal processing and system architectures is required.

Generally UWB antennas have been divided into four different categories, the scaled category comprising bowtie dipoles, see for example "A modified Bow-Tie antenna for improved pulse radiation", by Lestari et. al, IEEE Trans. Antennas Propag., Vol. 58, No. 7, pp. 2184-2192, July 2010, biconical dipoles as for example discussed in "Miniaturization of the biconical Antenna for ultra-wideband applications" by A. K. Amert et. al, IEEE Trans. Antennas Propag., Vol. 57, No. 12, pp. 3728-3735, December 2009, the second category comprising self-complementary structures as e.g. described in "Self-complementary antennas" by Y. Mushiake, IEEE Antennas Propag. Mag., vol. 34, No. 6, pp. 23-29, December 1992, the third category comprising travelling wave structure antennas, e.g. the Vivaldi antenna as discussed in "The Vivaldi aerial" by P. J. Gibson, Proc. $9^{th}$ European Microwave conference, pp. 101-105, 1979, and the fourth category comprising multiple resonance antennas like log-periodic dipole antenna arrays.

Antennas from the scaled, the self-complementary, and the multiple reflection categories comprise compact, low profile antennas with low gain, i.e. having wide and often more or less omnidirectional far field patterns, whereas antennas of the travelling wave category, like the Vivaldi antennas, are directional.

The above-mentioned UWB antennas were mainly designed for use in normal Line-of-Sight (LOS) antenna systems with one port per polarization and a known direction of the single wave between the transmitting and receiving side of the communication system.

In most environments, however, there are several objects (such as houses, trees, vehicles, humans) between the transmitting and receiving sides of communication systems causing reflections and scattering of the waves, resulting in a multiple of incoming waves on the receiving side, which is why a need for antennas better accounting for these factors has arisen. Interference between these waves causes large level variations known as fading of the received voltage (known as the channel) at the port of the receiving antenna. This fading can be counteracted in modern digital communication systems making use of multiport antennas and support MIMO technology (multiple-input multiple-output).

Wireless communication systems may comprise a large number of micro base stations with multiband multiport antennas enabling MIMO with high requirements as to compactness, angular coverage, radiation efficiency and polarization schemes, which all are critical issues for the performance of such systems. The radiation efficiency of a multiport antenna is reduced by ohmic losses and impedance mismatch as in single-port antennas, but, in addition, also by mutual coupling between the antenna ports. Earlier wideband antenna arrangements did not satisfactorily meet the requirements.

In WO2014/062112 a wideband compact multiport antenna suitable for MIMO communication systems as described above is disclosed, which has low ohmic losses, i.e. high radiation efficiency, good matching as well as low coupling between antenna ports. The geometry shown in FIG. 11 of WO2014/062112 is known as a dual-polarized self-grounded bowtie antenna, and is described in H. Raza, A. Hussain, J. Yang and P.-S. Kildal, "Wideband Compact 4-port Dual Polarized Self-grounded Bowtie Antenna", IEEE Transactions on Antennas and Propagation, Vol. 62, No., pp. 1-7, September 2014. However, due to its geometry, the self-grounded bowtie antenna is expensive to manufacture in large volumes, and in particular not suitable for mass production.

For future wireless communication systems, such as e.g. the fifth wireless generation (5G), the frequencies used may be up to 30 GHz, 60 GHz or even higher, up to and above 100 GHz. Massive MIMO is a challenging option for providing a sufficient gain and steer-ability at millimeter wave frequencies, see "Preparing for GBit/s Coverage in 5G: Massive MIMO, PMC Packaging by Gap Waveguides, OTA Testing in Random LOS" by Per-Simon Kildal, 2015 Loughborough Antennas & Propagation Conference, 2 & 3 Nov. 2015.

Massive MIMO array antennas, or Large-scale Antenna Systems or Very Large MIMO arrays etc. are, contrarily to hitherto known antenna systems, based on the use of a large number of antenna elements, from a few tenths to hundreds or even thousands thereof, for being operated independently to adapt coherently to the incoming wave or waves in the environments in such a way that the signal-to-noise ratio is maximized. Massive MIMO is particularly advantageous in that data throughput and energy efficiency can be considerably increased e.g. when a large number of user stations are scheduled simultaneously in a multi-user scenario.

MIMO arrays and Massive MIMO Array antennas consist of several equal antenna elements side by side. This makes manufacture as well as mounting extremely difficult, expensive and time consuming.

A massive MIMO array is the digital equivalent to a traditional phased array antenna. The phased array antenna contains analogue controllable phase shifters on all elements in order to phase-steer the antenna beam to the direction needed. In MIMO technology there is an Analogue to Digital Converter (ADC) or a Digital to Analogue Converter (DAC) on each element, so that all beam-steering is done digitally, and no analogue phase shifters are needed. This makes the MIMO antenna system much more flexible and adaptive than phased-arrays, so that any beam shape and even multiple beams can be formed. This is referred to as digital beam-forming.

All known antenna arrangements, even if meeting many of the functional requirements referred to above, suffer from the drawbacks of not being sufficiently easy and cheap to fabricate, and in particular not suitable for mass production. They are complex, have complicated structures and suffer from requiring geometries which are difficult to manufacture for high frequency applications in order to offer an UWB performance that is satisfactory as far as a radiation pattern requirements and requirements on reflection coefficients are concerned.

Ultra-wideband log-periodic dipole arrays as for example disclosed in "The circular eleven antenna: a new decade-bandwidth feed for reflector antennas with high aperture efficiency," by J. Yin, et. al, IEEE Trans. Antennas Propag., vol. 61, no. 8, pp. 3976-3984, August 2013, are tilted with an angle relative to the ground plane. In for example A. Hussain, J. Yang and P.-S. Kildal, "Wideband compact 4-port dual polarized self-grounded bowtie antenna," by H. Raza, et. al, IEEE Trans. Antennas Propag., vol. 62, no. 9, pp. 4468-4473, September 2014, curved radiating arms are connected to the ground plane. All such non-planar geometries are difficult to manufacture for high frequency applications.

Known UWB antennas further suffer from the disadvantage of requiring complicated and cumbersome feeding structures comprising baluns or 180° hybrids which are difficult to fabricate for high frequency applications.

In the architecture of waveguide arrays, conventional hollow waveguides are used to make slot or horn array antennas. Linearly polarized hollow waveguide corporate-feed slot antennas at 60 GHz as for example disclosed in "A 45 linearly polarized hollow-waveguide corporate-feed slot array antenna in the 60-GHz band," by T. Tomura, et.al, IEEE Trans. on AP, vol. 60, no. 8, pp. 3640-3646, 2012.), and linearly polarized CTS (Continuous Transverse Stub) antennas as e.g. disclosed in "The continuous transverse stub (CTS) array: Basic theory, experiment and application" by W. W. Milroy in Proc. Antenna Applications Symp., Allerton Park, ILy, Sep. 25-27, 1991.) at 30 GHz are typical examples. Such antennas are however very complicated and expensive to fabricate using existing manufacturing methods, such as soldering, welding or bonding.

In SIW (Substrate Integrated Waveguide) array architectures as shown in "60-GHz wideband substrate integrated-waveguide slot array using closely spaced elements for planar multisector antenna" by M. Ohira, et.al, IEEE Trans. on AP, vol. 58, no. 3, pp. 993-998, 2010), metal vias in a dielectric substrate, electrically connecting two parallel metal plates, are used to make a waveguide. An advantage of using SIW technology is that it allows for good integration possibilities and it is a low cost technology. However, SIW array architectures suffer from considerable ohmic losses even if they are lower than when microstrips are used type, and transmission losses due to radiation leakage occurring above 100 GHz are large since the spacing between metallized vias cannot be small enough for high frequencies to avoid radiation leakage due to fabrication constraints, see "Review of substrate integrated waveguide circuits and antennas" by M. Bozzi et.al, IET Microwaves, Antennas & Propagation, vol. 5, no. 8, pp. 909-920, 2011). This limits the use of SIW array architectures for applications above 100 GHz. Moreover, SIW antennas is are not suitable for large planar arrays with wideband performance due to its geometry.

In "Corporate-fed planar 60 GHz slot array made of three unconnected metal layers using AMC pin surface for the gap waveguide" by A. Vosoogh et.al, IEEE Antennas and Wireless Propagation Letters, pp. 1536-1225, 2015, a ridge gap waveguide slot array is disclosed which has a 25 dBi gain with a 14% relative bandwidth. However, the manufacturing costs of such antennas are very high due to the complicated geometrical feeding network structure. The manufacturing costs become significantly higher if a large aperture is required for a high gain (>38 dBi).

SUMMARY

It is therefore an object of the present invention to provide an antenna arrangement through which one or more of the above mentioned problems can be solved.

It is particularly an object of the invention to provide an antenna arrangement which is easy and cheap to fabricate. Still further it is a particular object of the invention to provide a bowtie antenna arrangement which is small and compact.

It is particularly an object of the invention to provide an antenna arrangement which has a high performance, is suitable for UWB applications, and has good radiation properties and radiation pattern.

It is an object to provide a large, or even very large, bandwidth antenna arrangement.

It is also a particular object to provide an antenna arrangement allowing the use of a simple, compact feeding structure, particularly in combination with an excellent UWB performance. Further yet it is a particular object to provide a compact multiport antenna, most particularly with low mutual coupling between the ports.

Another object of the invention is to provide an antenna arrangement which is suitable for mass production. It is also one most particular object to provide an antenna arrangement which is flexible and a concept that allows for fabrication of different antenna arrangements based on the same principles for many different applications.

A particular object is to provide an antenna arrangement that can be used for very high frequencies, e.g. up to 100 or even up to 300 GHz or more.

Another particular object is to provide an UWB multiport antenna for a MIMO system.

Yet another particular object is to provide an UWB multiport antenna for future mobile phones or other user devices.

Another most particular object is to provide an antenna arrangement suitable for Massive MIMO, and particularly for future 5G communication systems.

It is also a particular object of the invention to provide an antenna arrangement that can be used in phased arrays and in MIMO arrays.

Another particular object is to provide an UWB multiport antenna as a feed for reflectors in applications, such as in radio telescopes and backhaul point-to-point links.

Further it is an object to provide an antenna arrangement suitable for micro base stations for wireless communication, e.g. also enabling reduction of multipath fading effects.

Still another object is to provide a bowtie antenna arrangement, most particularly an UWB multiport antenna, which is suitable for use in measurement systems for wireless devices with or without MIMO capability, such as measurement systems based on reverberation chambers, or for use in OTA (Over-The-Air) test systems in anechoic chambers or other measurement facilities for wireless communication to vehicles, e.g. cars.

Therefore an arrangement as initially referred to is provided which has the characterizing features of claim 1.

Advantageous embodiments are given by the appended dependent claims.

It is an advantage that an antenna arrangement is provided which is very easy and cheap to fabricate, also for high and even very high frequencies, and which also is easy to mount, has a simple structure, is compact, and, at least in particular embodiments, comprises a non-complicated feeding structure. Another advantage is that an antenna arrangement is provided which is suitable for mass-production and which can be fabricated with a high repeatability. It is also an advantage that a multiport antenna arrangement providing these advantages in addition has a weak mutual coupling between the antenna ports, so that the far field functions become almost orthogonal. Particularly a multiport antenna arrangement with a weak mutual coupling between the antenna ports is provided which ensures that far field functions are orthogonal in some sense, such as in terms of polarization, direction or shape. With orthogonal is here meant that the inner products of the complex far field functions are low over the desired coverage of the antenna arrangement. Particularly, an UWB antenna arrangement which, in addition to being extremely easy and cheap to fabricate, also is suitable for measurement systems for wireless devices of wireless systems, with or without MIMO capability, most particularly for Massive MIMO, which may have multiple ports, with a weak coupling, particularly no coupling at all, or at least a coupling which is as low as possible between them, and orthogonal far field functions.

The inventive concept is also advantageous for antenna arrangements for use in MIMO antenna systems for statistical multipath environments, most particularly for Massive MIMO antenna systems.

It is an advantage of the invention that it facilitates manufacturing and assembly and enables a considerable reduction in manufacturing and assembly costs through the provisioning of elements, that can be mass-produced, and which comprises flat bowties and which comprises a compact and simple feeding structure.

An antenna arrangement containing two opposing halves or arms is herein referred to as a bowtie. However, each arm can also be used separately as a half-bowtie antenna element. Commonly two full bowtie antenna arrangements are mounted orthogonal to each other to form a dual-polarized bowtie arrangement as described in the references WO2014/062112 and H. Raza, A. Hussain, J. Yang and P.-S. Kildal, "Wideband Compact 4-port Dual Polarized Self-grounded Bowtie Antenna", IEEE Transactions on Antennas and Propagation, Vol. 62, No., pp. 1-7, September 2014 referred to above. According to the present invention, for example for making a dual-polarized or multi-polarized bowtie, one and the same arm can in advantageous embodiments be used as an arm in each of two bowties structures which can be differentially excited to form a dual polarized two-port or multi-port antenna, e.g. meaning that only three arms are needed for two bowties etc.

BRIEF DESCRIPTION OF THE DRAWINGS

The invention will in the following be further described in a non-limiting manner, and with reference to the accompanying drawings, in which.

DETAILED DESCRIPTION

Figure 1:
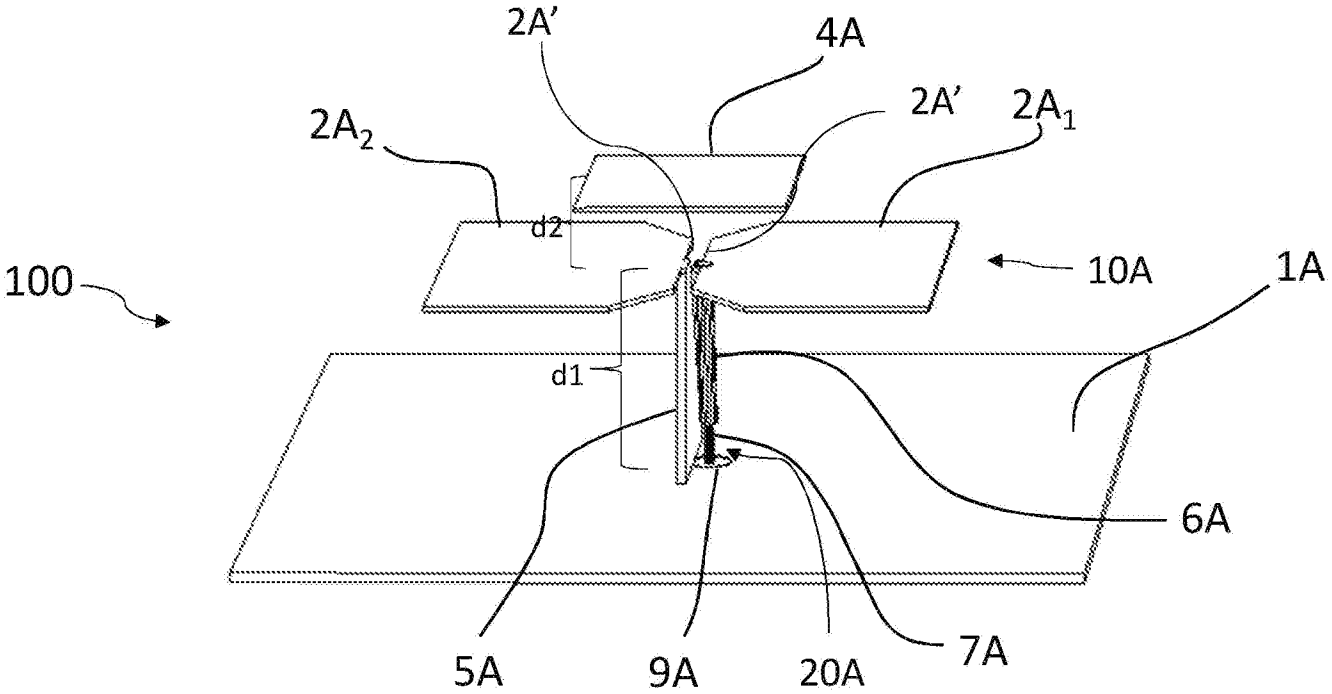
FIG. 1 is a view in perspective of an antenna arrangement according to a first embodiment of the present invention, comprising a linearly-polarized bowtie antenna.

FIG. 1 shows a first embodiment of a bowtie antenna arrangement 100 according to the invention which comprises one bowtie structure 10 comprising two bowtie arm sections $\mathbf{2}A_1,\mathbf{2}A_2$ made of an electrically conducting material which are arranged in a same plane, here also called a bowtie arm section plane, and so that respective narrower end portions thereof 2A',2A' point substantially towards one another, face one another, at a distance from an upper side of a metal ground plane 1A (or in alternative embodiments a PCB (Printed Circuit Board)). The bowtie arm section plane and the ground plane 1A are thus disposed in parallel. The bowtie arm sections $\mathbf{2}A_1,\mathbf{2}A_2$ are held in place at the distance from the ground plane 1A by means of a supporting arrangement (not shown in FIG. 1), preferably a mechanical supporting arrangement comprising a common supporting element or separate supporting elements for each bowtie arm section $\mathbf{2}A_1,\mathbf{2}A_2$, (see e.g. FIG. 1C). It should be clear that the invention is not limited to any particular supporting arrangement, but that a supporting arrangement can be provided for in many different manners for keeping the bowtie arm sections in the bowtie arm section plane located at a desired distance from the ground plane 1A. In some embodiments the distance comprises about an eighth of the wavelength at the lower end frequency in a desired operation frequency band. It should be clear that the distance is not limited to an eighth of the wavelength at the lower end frequency band; it can be larger as well as smaller. The lower the desired lower end frequency, the larger the distance should be, and vice versa.

The end portions 2A',2A' of the two bowtie arm sections $\mathbf{2}A_1,\mathbf{2}A_2$ are located at a slight distance from each other which depends on the operating frequency. For an UWB antenna it is not important to specify a distance for a single frequency, but the distance is very small in terms of the wavelength at the lower end frequency of the desired frequency band, e.g. less or much less than approximately one tenth of the wavelength at the low end frequency of the desired frequency band.

At a distance from the two bowtie arm sections $\mathbf{2}A_1,\mathbf{2}A_2$, in parallel with the bowtie arm section plane, a capping arrangement 4A is located, which here comprises a metallic cap of a substantially rectangular shape, disposed in a cap plane also in parallel with the bowtie arm section plane and the ground plane 1A, but on the opposite side of the bowtie arm section plane with respect to the ground plane 1A. The metal cap 4A is located centralized with respect to the bowtie arm section end portions 2A',2A', and the distance between the bowtie arm sections $\mathbf{2}A_1,\mathbf{2}A_2$ and the cap 4A comprises about one sixteenth of the wavelength at the lower end frequency in a desired operation frequency band, and thus comprises about half the distance between the ground plane 1A and the bowtie arm section plane. Of course the distance can be larger as well as smaller.

The cap 4A preferably comprises a symmetrically located patch in the direction of the longitudinal extension of the bowtie arm sections. It may be circular, square shaped, rectangular or of any other appropriate shape and has a size substantially corresponding to about one eighth (diameter, side of square shaped patch/long side of a rectangle) of the wavelength at the lower end frequency in a desired operation frequency band. The dimension of the patch in a direction perpendicular to the longitudinal extension is not so critical and can have different values. Through the provisioning and arrangement of the cap 4A as discussed above, the radiation beam of an UWB can be made substantially constant, which is extremely advantageous. The capped bowtie antenna arrangement 100 can be said to be a combination of Yagi antenna and a stacked patch antenna. Firstly, as a known working principle, multilayer stacked patches can increase the bandwidth of patch antennas. The principle of stacked patches is here thus applied to a bowtie antenna. The enhancement of bandwidth achieved for the bowtie antenna 100 by using a cap 4A (one stacked patch) is much larger than what is normal for patch antennas. The first reason therefor is that, at low frequencies, the radiation element is mainly formed by the bowtie arm sections, where the cap 4A does not radiate (much smaller than half a wavelength) and works as a capacitor to turn impedance matching. At high frequencies, on the other hand, the cap 4A works as a radiating patch and the bowtie arm sections as a feeding (excitation) for the cap 4A. Therefore, at low as well as at high frequencies, the capped bowtie antenna arrangement 100 radiates as a half-wave dipole, which makes the radiation patterns almost constant at the two ends of frequency band. Secondly, the cap 4A works as a director as in a Yagi antenna. A Yagi antenna is made of a reflector (the ground plane in capped Bowtie), a driven element (the Bowtie) and a director (the cap). The bowtie structure 10A according to the present invention will act as the driven element, the ground plane 1A as the reflector and the cap 4A as the director. So a compact Yagi antenna is made, where the cap provides a directional radiation pattern (keeping the beam not split). Therefore, at a middle bandwidth, this Yagi principle makes the radiation pattern almost constant.

A metal support element 5A is arranged between the ground plane 1A and the end portion 2A' of one of the bowtie arm sections $2A_1$, the main purpose of which being to act as a feeding line ground plane for a feeding line, here an inner conductor 7A of a coax connection here arranged in a metal conductor post 6A. The metal post 6A may have any appropriate cross section, such as circular, square shaped, rectangular, elliptic etc.

The ground plane 1A is provided with a hole or an opening 9A through which the inner conductor 7A passes, and on the opposite side of the ground plane a coax connector (not shown in FIG. 1, cf. FIG. 1A) is provided acting as an input antenna port. The metal support element 5A in one embodiment is formed in one piece with, integral with, the bowtie arm section $2A_2$. A bent single piece of metal may in such an embodiment used to form the bowtie arm section $2A_2$ and the metal support element 5A, by being bent substantially 90° at a connection region 25A located at the center of the end portion 2A' of the bowtie arm section $2A_2$. The metal support element 5A may be connected to the ground plane 1A e.g. by means of any attachment means such as screws or bolts etc. or be fixed thereto by means of soldering or similar, and thus be either permanently secured or detachably secured thereto. The metal support element 5A may also comprise a separate element adapted to be releasably or fixedly secured to the central portion of the end portion 2A' of the bowtie arm section $2A_2$ by means of fastening means as discussed above or by means of welding, soldering pop riveting or similar.

Through appropriate selection of the shape and the size of the bowtie arm sections $2A_1$,$2A_2$ and of the cap 4A, it becomes possible to obtain substantially equal radiation in the E-, and H-planes. A first reason therefor is that the capped bowtie can be said to form or act as a compact Yagi antenna as discussed above, and a Yagi antenna has almost equal E- and H-plane radiation patterns. Secondly, if further the capped bowtie antenna arrangement has relatively wide bowtie arms (almost square shaped or circular etc.) and a relatively wide cap (square shaped, circular, rectangular with a relatively large width perpendicularly to the longitudinal extension of the bowtie arm sections), the current distribution over the bowtie arm sections and the cap will be similar in both E- and H-planes, which makes the E-plane and H-plane radiation pattern similar. It should be clear that the invention is not limited to embodiments with such wide bowtie arm sections and caps; these can be advantageous features contributing additionally in providing substantially equal radiation in the E-, and H-planes when this is desired and at issue.

As referred to above, advantageously a feeding arrangement comprising a coaxial feeding line and a coaxial connector is used for frequencies up to about 90 GHz, or even up to about 110 GHz, or for microwave implementations and millimeter waves up to about 110 GHz.

The bowtie arm sections $2A_1$,$2A_2$ and the cap 4A are in advantageous embodiments made of metal sheets, and for example a plastic support arrangement is used for supporting, arranging, the bowtie arm sections at a distance from the ground plane 1A and the cap 4A at a distance from the bowtie arm sections.

Since the elements, the bowtie arm sections, the caps etc. are planar, a compact arrangement which is easy and cheap to fabricate is provided.

For millimeter waves, e.g. for frequencies above about 30 GHz, other feeding arrangements are preferably used, and PCB-technology or on wafer-technology etc. is advantageously used for providing support for the bowtie arm sections and the caps due to the extremely small sizes at millimeter waves, as will be more thoroughly discussed below with reference to FIGS. 6-8J. Since for mm waves, antenna arrangements have to be even smaller than microwave antenna arrangements, it is extremely advantageous that all elements are planar, flat, which facilitates, or even enables, manufacture.

Figure 1A:
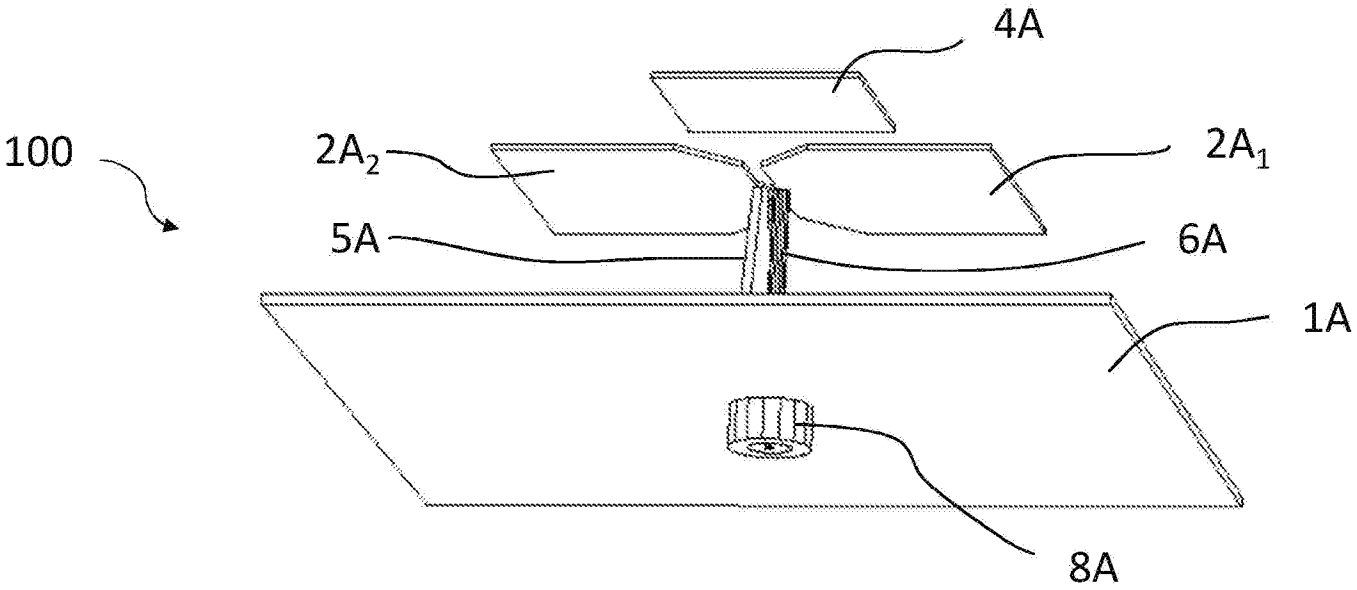
FIG. 1A is a view from below in perspective of an antenna arrangement as in FIG. 1.

FIG. 1A is a schematic view in perspective from below showing the antenna arrangement 100 of FIG. 1 with a coaxial connector 8A arranged on the side of the ground plane 1A opposite to the side where the bowtie arm sections $2A_1$,$2A_2$ are provided for feeding of the antenna arrangement. Thus, according to the invention it is not necessary to use any balun or 180° hybrid for feeding of the antenna, which is extremely advantageous. The other elements illustrated in FIG. 1A have already been discussed with reference to FIG. 1 and bear the same reference numerals and will therefore not be further discussed here.

Figure 1B:
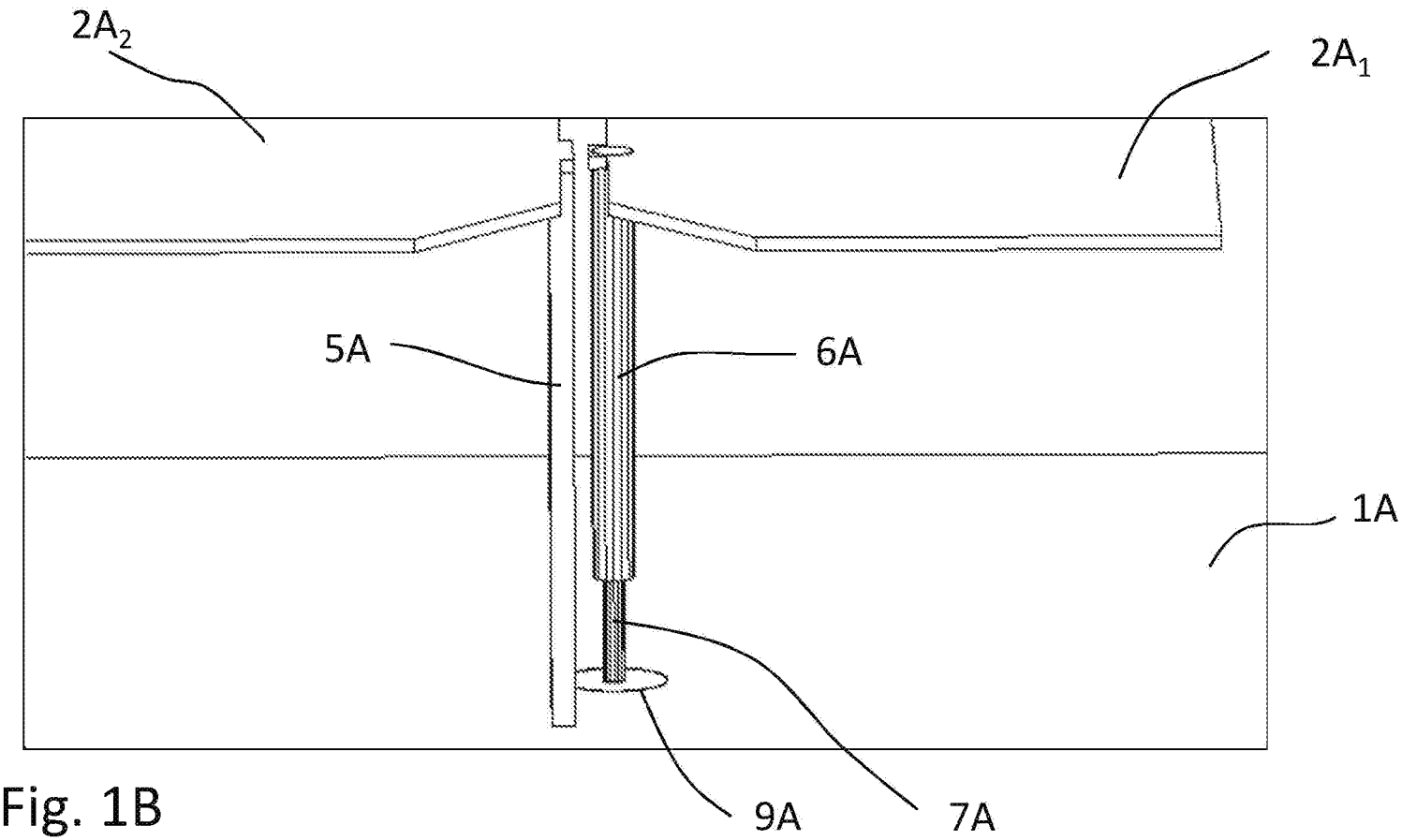
FIG. 1B is an enlarged view of a section of the antenna arrangement in FIG. 1.

FIG. 1B is an enlarged view of part of the antenna arrangement 100 shown in FIG. 1 showing the bowtie arm sections $2A_1$,$2A_2$, the metal support element 5A acting as a ground plane for the inner conductor 7A of the metal conductor post 6A connected between the ground plane 1A and, here a protruding section at the center of the end portion 2A' of the bowtie arm section $2A_1$, and the metal conductor post 6A connected to the center of the end portion 2A' of the other bowtie arm section $2A_2$ more in detail. It should be clear that the bowtie arm sections $2A_1$,$2A_2$ can have different flat shapes, continuously or discretely tapering towards an end portion, having a substantially semicircular end portion, may comprise end tips, may be straight, have the shape of hyperbolas, be of an elliptic or triangular shape, or be stepped etc. Many alternatives are possible, only some of which being shown. In FIG. 1B also the hole 9A in the ground plane 1A for receiving the inner conductor 7A which on the other side of the ground plane comprises a coaxial connector. The cap 4A is not shown in FIG. 1B.

The shapes of the bowtie arm sections and of the cap have different effects on impedance matching over a wide bandwidth. For example, purely rectangular bowtie arm sections and cap have better impedance matching in a low frequency band, whereas bowtie arm sections and caps having a hexagonal shape have better performance in a high frequency band. Therefore, for different applications, different shapes for the bowtie arm sections and caps may be used. Further, in order to make a compact array using a capped bowtie antenna arrangement according to the present invention, different shapes for the bowtie arm sections and the caps may be used. For example, rectangular shapes can be used for a linearly polarized capped bowtie array while for a dual polarized array, a hexagonal shape may be used in order to separate the elements (not touching each other). A circular shape is symmetric, and is very suitable for dual polarization and easy to manufacture. Many variations are possible, these merely being a few examples to which the invention by no means is restricted, and other shapes than the ones proposed above for the different implementations, as well as for other implementations and embodiments.

Figure 1C:
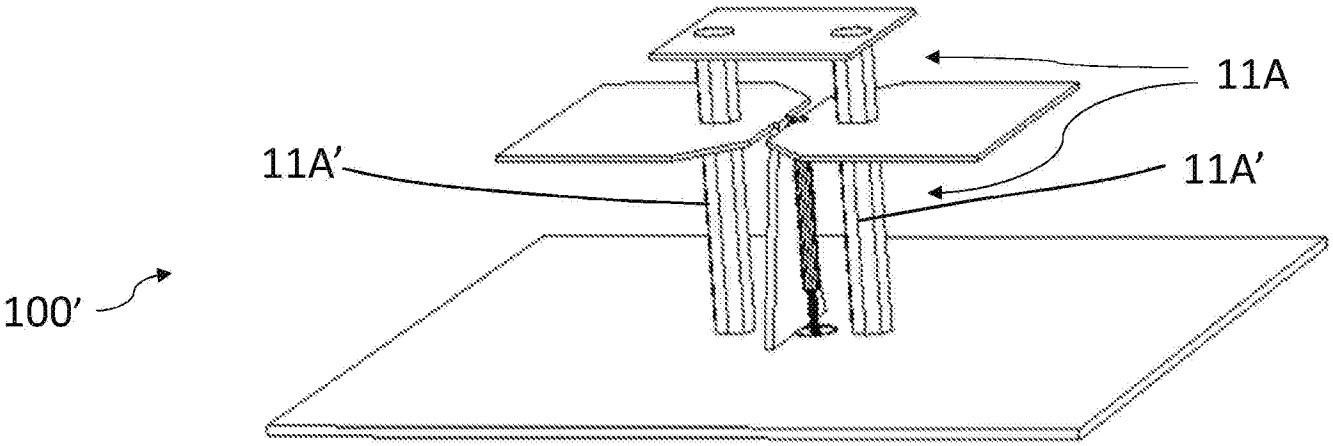
FIG. 1C shows an exemplary support arrangement for an antenna arrangement as in FIG. 1 in a particular embodiment.

FIG. 1C shows an antenna arrangement 100 as in FIG. 1 with an exemplary supporting arrangement 11A comprising two plastic posts 11A',11A' supporting the bowtie arm sections $2A_1$,$2A_2$ and the cap 4A. In this particular embodiment the two plastic posts 11A',11A' pass through each a respective hole in the bowtie arm sections $2A_1$,$2A_2$, snugly fitting therein such that the respective bowtie arm sections $2A_1$,$2A_2$ will stay in place at the desired distance from the ground plane; alternatively the bowtie arm sections $2A_1$,$2A_2$ are thread onto the posts and supported by protrusions provided on the posts such that the bowtie arm sections $2A_1$,$2A_2$ will be secured at the desired distance above the ground plane 1A. In this embodiment, the cap 4A rests on upper ends of the plastic posts 11A',11A', at a desired distance from the bowtie arm sections $2A_1$,$2A_2$. The cap 4A is secured to the plastic posts in any appropriate manner. In some embodiments the cap 4A is provided with holes receiving the posts, or with recesses, and/or it may be welded, soldered or glued on to the plastic posts or secured thereto in any appropriate manner. A supporting arrangement can take many different forms and may alternatively comprise separate elements for supporting each one of the bowtie arm sections $2A_1$,$2A_2$ and the cap 4A, or a common arrangement for supporting both bowtie arm sections $2A_1$, $2A_2$, or even a common arrangement, or structure, for supporting bowtie arm sections as well as one or more caps.

Figure 2:
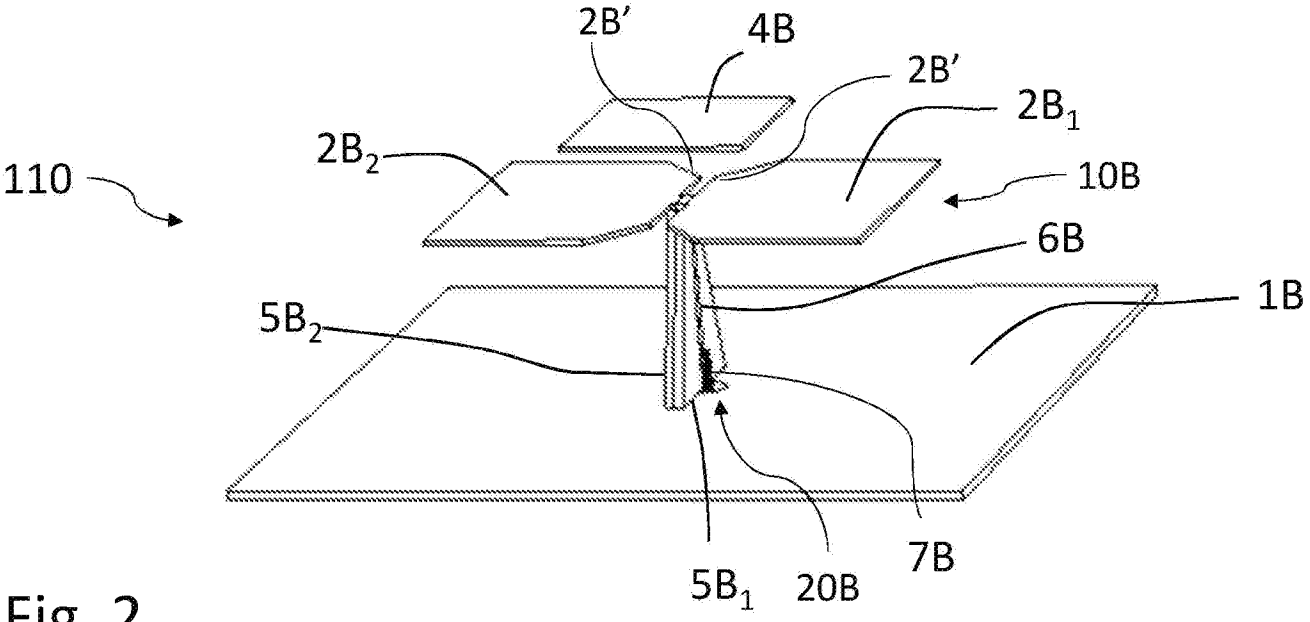
FIG. 2 is a view in perspective of an antenna arrangement comprising a single-polarized bowtie antenna with a feeding arrangement comprising a microstrip line and a coaxial connector according to another embodiment.

FIG. 2 shows an embodiment comprising an antenna arrangement 110 comprising a bowtie structure 10B similar to the bowtie structure of FIG. 1. It comprises two bowtie arm sections $2B_1$,$2B_2$ made of an electrically conducting material, which are arranged in a bowtie arm section plane, and which comprise end portions with, here, a tapering section 2B',2B' ending with a respective straight edge perpendicular to longitudinal edges of the bowtie arm sections such that the straight edges of each a bowtie arm section face one another. The bowtie arm sections $2B_1$,$2B_2$ are located at a distance from an upper side of metal ground plane 1B (or, in an alternative embodiment a PCB (Printed Circuit Board). The bowtie arm section plane and the ground plane 1B are as described with reference to FIG. 1 disposed in parallel. The bowtie arm sections $2B_1$,$2B_2$ are held in place at the distance from the ground plane 1B by means of a supporting arrangement (not shown in FIG. 2), preferably a mechanical supporting arrangement comprising a common supporting element or separate supporting elements for each bowtie arm section $2B_1$,$2B_2$, for example a mechanical supporting arrangement as shown in FIG. 2C below, or any other appropriate supporting arrangement.

In some embodiments the distance between the arm sections and the ground plane is about an eight of the wavelength at the lower end frequency in a desired operation frequency band as also discussed with reference to the embodiment illustrated in FIG. 1. It should be clear that the distance also in this embodiment is not limited to an eighth of the wavelength at the lower end frequency band; it can be larger as well as smaller. The lower the desired lower end frequency, the larger the distance should be, and vice versa.

The end portions 2B',2B' of the two bowtie arm sections $2B_1$,$2B_2$ are located at a slight distance from each other which depends on the operating frequency as also discussed with reference to FIG. 1.

At a, here called second, distance d2 from the two bowtie arm sections $2B_1$,$2B_2$, in parallel with the bowtie arm section plane, a capping arrangement 4B is provided, which comprises a substantially square shaped metallic cap. The metal cap 4B is located in a symmetric, centralized manner with respect to the bowtie arm section end portions 2B',2B' as also discussed with reference to the embodiment of FIG. 1, and the distance d2 between the bowtie arm sections $2B_1$,$2B_2$ and the capping arrangement 4B comprises about one sixteenth of the wavelength at the lower end frequency in a desired operation frequency band, and thus comprises about half the distance d1 between the ground plane 1B and the bowtie arm section plane. Similar considerations and variation possibilities as those discussed above with reference to FIGS. 1-1C are applicable also for embodiments as in FIG. 2, and similar elements bear the same reference signs but are indexed "B".

The metal cap may alternatively be circular, rectangular or of any other appropriate shape and has a size substantially corresponding to about one eighth (diameter, side of square shaped patch/long side of a rectangle) of the wavelength at the lower end frequency in a desired operation frequency band (also here reference is made to the above description in relation to FIG. 1).

As in the embodiment shown in FIGS. 1-1C, a metal support element $5B_2$ is arranged between the ground plane 1B and the end portion 2B' of one of the bowtie arm sections $2B_2$, the main purpose of which being to act as a feeding line ground plane for a feeding line.

The feeding arrangement 20B differs from the feeding arrangement shown in FIG. 1 and here comprises a microstrip line 6B which in combination with a coaxial connector 8B (not shown in FIG. 2; cf. FIG. 2A) arranged on the opposite side of the ground plane 1B is used for feeding of the antenna arrangement 110. The metal support $5B_2$ is connected between bowtie arm section $2B_2$ and the ground plane 1B and acts as a ground plane for microstrip line 6B arranged on a substrate board $5B_1$ arranged in parallel with, and for example associated with, and of the same shape as, the metal support $5B_2$. An inner conductor 7B of the coaxial connection is here soldered to the microstrip line 6B. The ground plane is provided with a hole or an opening 9B through which the inner conductor 7B passes, and on the opposite side of the ground plane the coax connector 8B (cf. FIG. 2A) of the coaxial connection is provided which acts as an input antenna port.

The metal support element $5B_2$ in one embodiment is formed in one piece with, integral with, the bowtie arm section $2B_2$ and a bent single piece of metal can be used to form the bowtie arm section $2B_2$ and the metal support element $5B_2$, by being bent substantially 90° as also discussed more in detail with reference to the previous embodiments. The metal support element $5B_2$ may hence be connected to the ground plane 1B e.g. by means of any attachment means such as screws, bolts, pop rivets etc. or be fixed thereto by means of welding, soldering, gluing or similarly, and thus be either permanently secured or detachably secured thereto. The metal support element $5B_2$ may also comprise a separate element adapted to be secured releasably or fixedly secured to the central portion of the end portion 2B' of the bowtie arm section $2B_2$ by means of fastening means as discussed above or by means of welding, soldering or similar.

Through appropriate selection of the shape and the size of the bowtie arm sections and of the cap, it becomes possible to obtain substantially equal radiation in the E-, and H-planes as also discussed with reference to the embodiment of FIG. 1.

As referred to above, advantageously the feeding arrangement 20B is used for frequencies up to about 90 GHz, or even up to about 110 GHz, or for microwave implementations and also for mm-waves up to about 110 GHz.

The bowtie arm sections and the caps are made of metal sheets, and for example a plastic support arrangement is used for supporting, arranging, the bowtie arm sections at a distance from the ground plane 1B and the cap 4B at a distance from the bowtie arm sections.

Figure 2A:
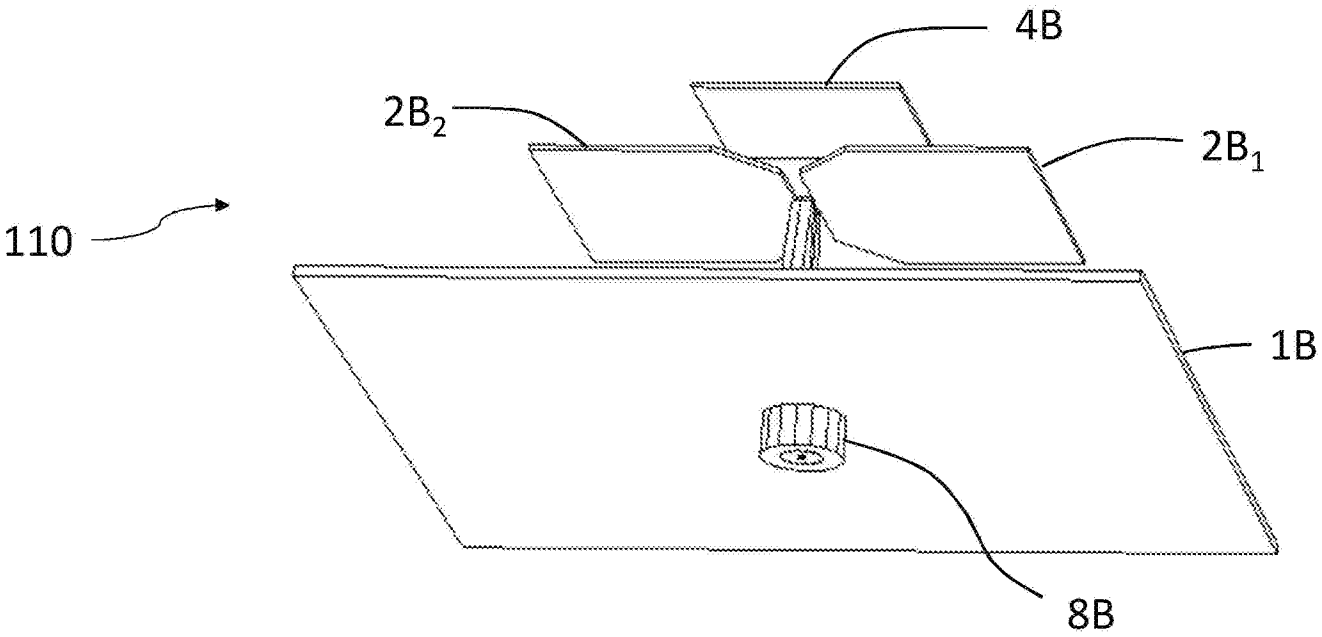
FIG. 2A is a view in perspective from below of the antenna arrangement of FIG. 2.

FIG. 2A is a schematic view in perspective from below showing the antenna arrangement 110 of FIG. 2 with a coaxial connector 8B arranged on the side of the ground plane 1B opposite to the side where the bowtie arm sections are provided, for feeding of the antenna arrangement. It is extremely advantageous that a coaxial connector can be used and that it is not necessary to use any balun or 180° hybrid for feeding of the antenna, even if the invention also covers embodiments in which such feeding arrangements are used, as also discussed with reference to FIGS. 1,1A. The other elements illustrated in FIG. 2A have already been discussed with reference to FIG. 2 and will therefore not be further discussed here.

Figure 2B:
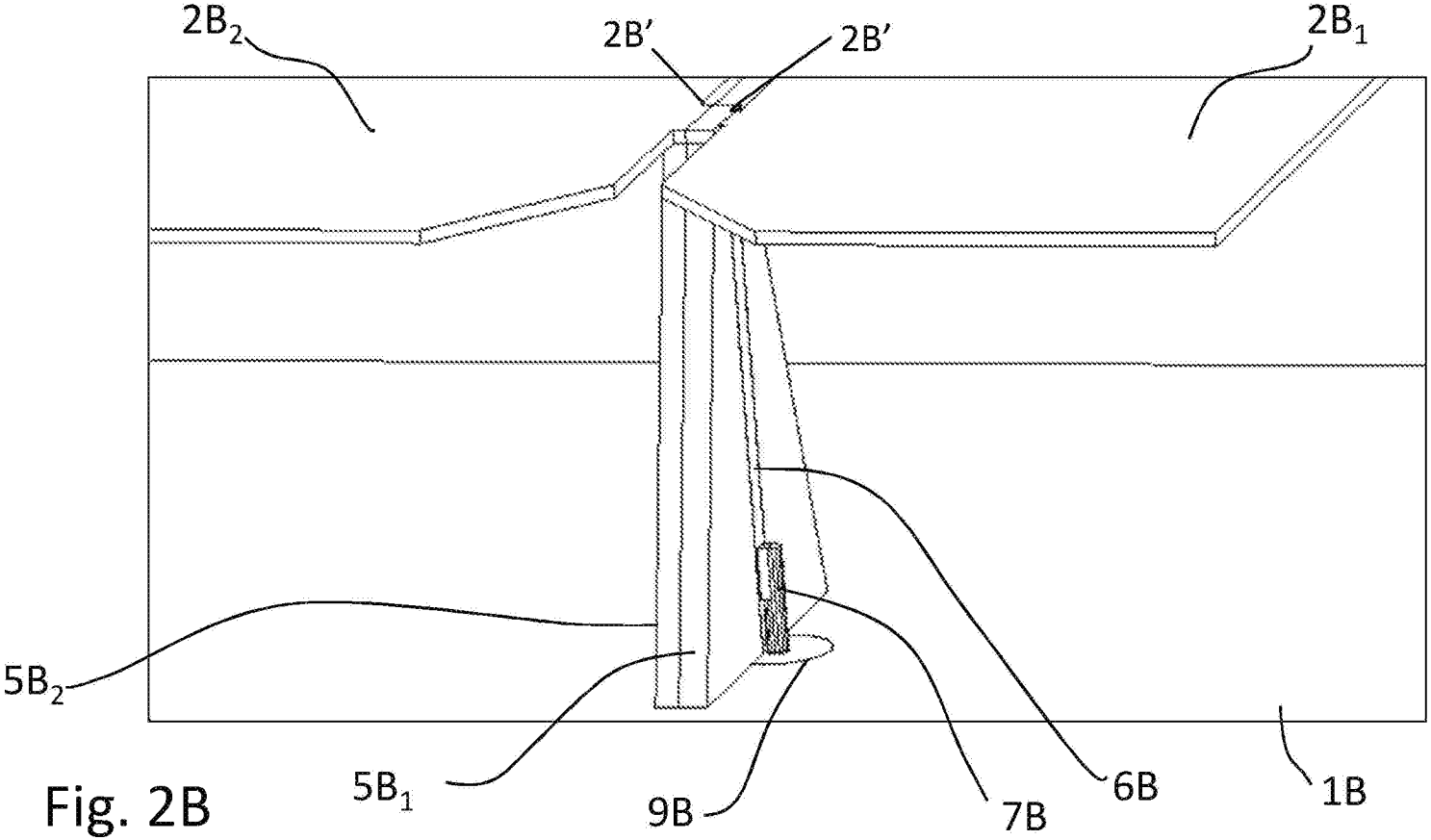
FIG. 2B is an enlarged view in perspective showing the microstrip line and an inner conductor of the coaxial connector of the feeding arrangement of the antenna arrangement shown in FIG. 2.
Figure 2C:
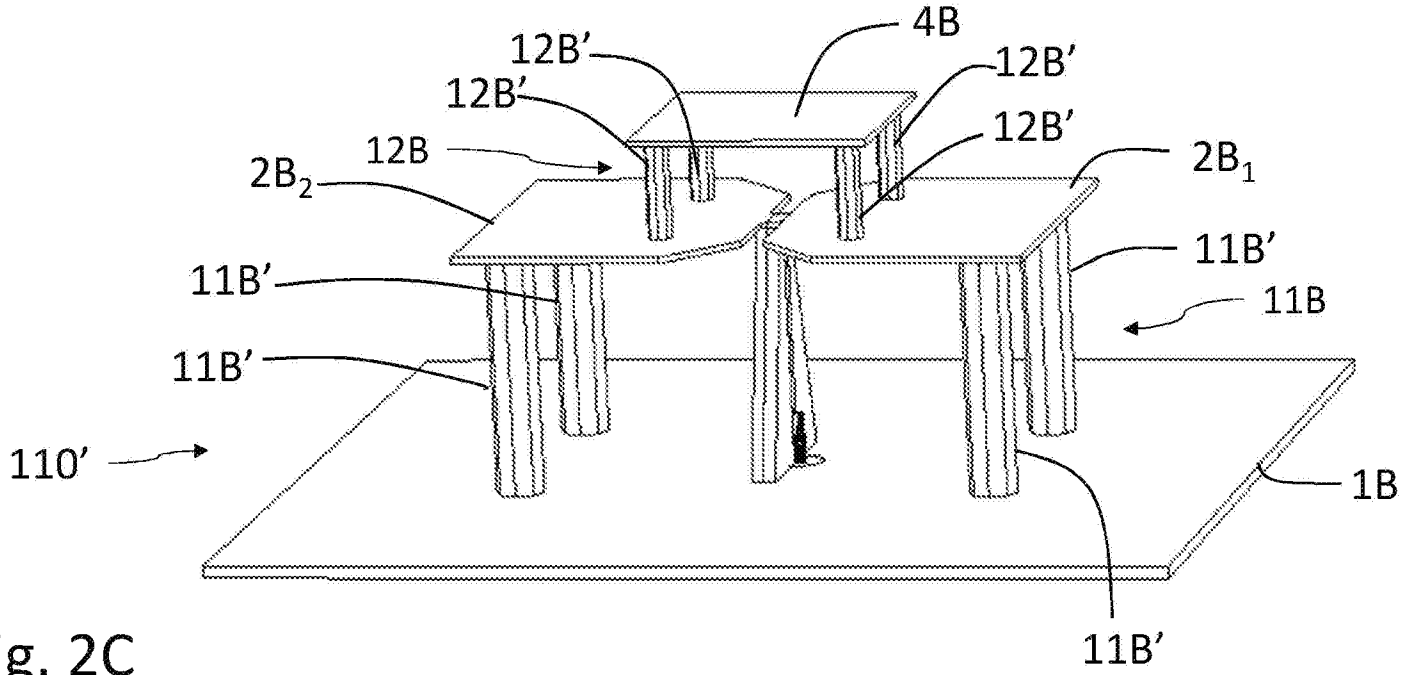
FIG. 2C is a view in perspective of an embodiment of a supporting arrangement of an antenna arrangement as in FIG. 2.

FIG. 2B is an enlarged view of part of the antenna arrangement 110 shown in FIG. 2 showing the bowtie arm sections $2B_1$,$2B_2$, the metal support element $5B_2$ acting as a ground plane for the microstrip line 6B arranged on substrate board $5B_1$ and the inner conductor 7B of the coaxial connector 8B (cf. FIG. 2A) more in detail. It should be clear that the bowtie arm sections $2B_1$,$2B_2$ can have different flat shapes, continuously or discretely tapering towards an end portion, have substantially semicircular end portions, may comprise end tips, may have straight end portions, may have the shape of hyperbolas, elliptic shapes, be triangular, have a stepped end portion etc. Many alternatives are possible, only some of which being shown. In FIG. 2B is also shown the opening or the hole 9B in the ground plane 1B adapted for reception of the inner conductor 17B which on the other side of the ground plane comprises the coaxial connector. The cap 4B is not shown in FIG. 2B.

FIG. 2C shows an antenna arrangement 110 as in FIG. 2 with an exemplary supporting arrangement comprising a first supporting arrangement part 11B for supporting the bowtie arm sections $2B_1$,$2B_2$ and a second supporting arrangement part 12B for supporting the cap 4B. The first supporting arrangement part 11B comprises four plastic posts 11B', . . . , 11B' of which each two are adapted to support a respective bowtie arm section $2B_1$,$2B_2$ and are arranged between the respective bowtie arm section $2B_1$,$2B_2$ and the ground plane 1B, preferably at an end portion 2B',2B' of the bowtie arm section $2B_1$,$2B_2$ distant from the other facing end portion of the other bowtie arm section $2B_2$,$2B_1$. The second supporting arrangement part 12B comprises also four plastic posts 12B', . . . , 12B' arranged pairwise between each a bowtie arm section $2B_1$,$2B_2$ and the cap 4B, here substantially in the corners of a substantially square shaped cap 4B. The cap 4B is secured to the plastic posts 12B', . . . , 12B' in any appropriate manner. In some embodiments the cap 4B is provided with holes or recesses for receiving the posts, and/or it may be welded, soldered, glued or similarly on to the plastic posts. Also in embodiments with a feeding arrangement as in FIG. 2, a supporting arrangement as in FIG. 1C can alternatively be used.

A supporting arrangement can take many different forms and comprise separate elements for supporting the bowtie arm sections $2B_1$,$2B_2$ and the cap 4B, or a common arrangement for supporting both bowtie arm sections $2B_1$,$2B_2$, or even a common arrangement, or structure, for supporting bowtie arm sections as well as one or more caps.

Figure 3:
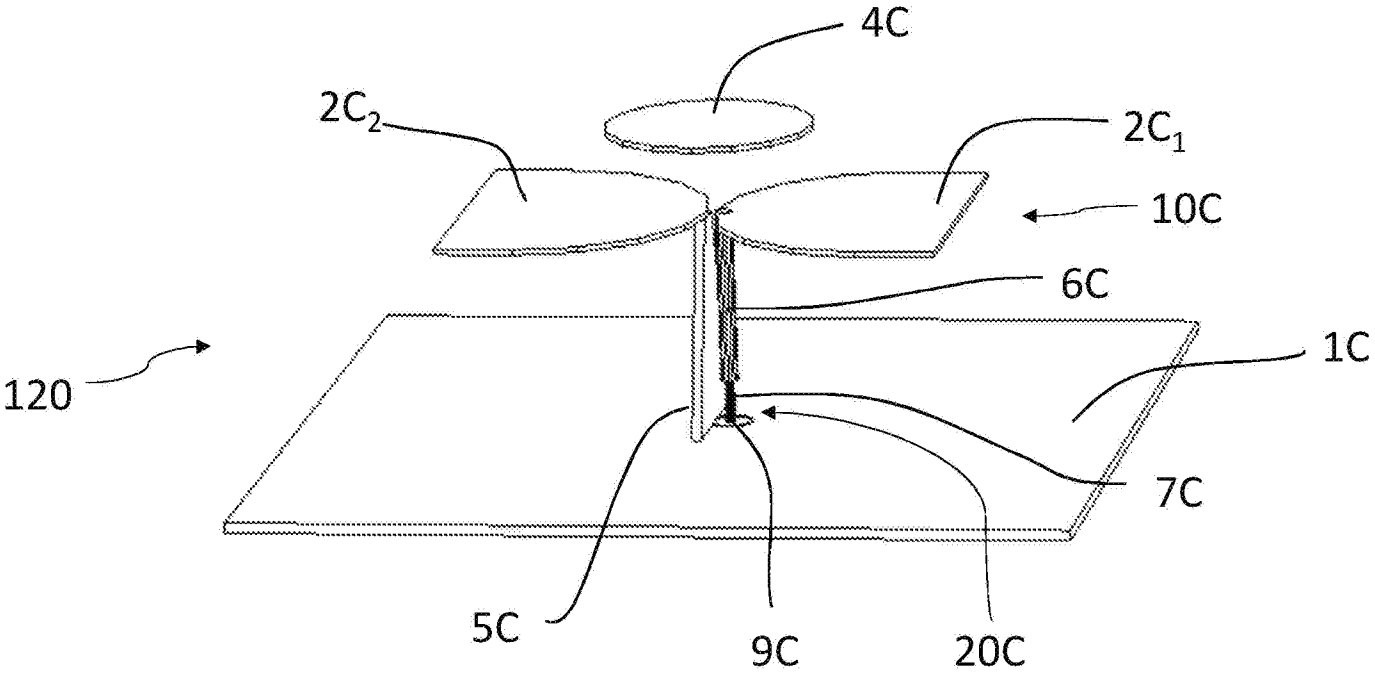
FIG. 3 is a schematic view in perspective of another embodiment of an antenna arrangement.

FIG. 3 shows still another embodiment of a bowtie antenna arrangement 120 according to the invention which comprises a bowtie structure 10C with two flat bowtie arm sections $2C_1$,$2C_2$ made of an electrically conducting material and arranged in a same plane and so that respective narrower end portions thereof 2C',2C' point substantially towards one another, face one another, at a distance from an upper side of a metal ground plane 1C. The bowtie arm section plane and the ground plane 1C are disposed in parallel as discussed with reference to the embodiments described with reference to FIGS. 1,2. The bowtie arm sections $2C_1$,$2C_2$ are held in place at the distance from the ground plane 1C by means of a supporting arrangement (not shown in FIG. 1), e.g. a supporting arrangement as described with reference to FIG. 1C or FIG. 2C, or any other appropriate supporting arrangement for keeping the bowtie arm sections at a desired distance from the ground plane 1C. In some embodiments the distance comprises about an eighth of the wavelength at the lower end frequency in a desired operation frequency band, but also in this embodiment the distance is not limited to an eighth of the wavelength at the lower end frequency band as also discussed with reference to FIG. 1, similar considerations and variation possibilities apply and the distance can be larger as well as smaller. The lower the desired lower end frequency, the larger the distance should be, and vice versa.

The end portions 2C',2C' of the two bowtie arm sections $2C_1$,$2C_2$ are located at a slight distance from each other which depends on the operating frequency, preferably less than $\lambda/10$, $\lambda$ being the wavelength at the lower end frequency of the desired frequency band, at least for high frequency applications where it has to be very small, for lower frequencies the distance is less critical, which also applies to the other embodiments.

At a distance from the two bowtie arm sections $2C_1$,$2C_2$, in parallel with the bowtie arm section plane, a capping arrangement 4C comprising a metal cap of a substantially circular shape, is disposed in parallel with the plane of the bowtie arm sections The metal cap 4C is located centralized with respect to the bowtie arm section end portions 2C',2C', and the distance between the bowtie arm sections $2C_1$,$2C_2$ and the cap 4B comprises about one sixteenth of the wavelength at the lower end frequency in a desired operation frequency band, and thus comprises about half the distance between the ground plane 1C and the bowtie arm section plane, as also discussed earlier in this application.

The cap 4C here comprises a symmetrically located circular patch which has a diameter substantially corresponding to about one eighth of the wavelength at the lower end frequency in a desired operation frequency band.

Through the use of a circular cap 4C a high degree of symmetry is obtained and it is also very easy to fabricate and mount.

The bowtie antenna arrangement 120 also differs from the bowtie antenna arrangement 100 shown in FIG. 1 in that the bowtie arm sections $2C_1$,$2C_2$ are curved. In other respects the bowtie antenna arrangement 120 is similar to the bowtie antenna arrangement 100 described with reference to FIGS. 1-1C and like elements bear the same reference numerals but indexed "C".

Through using curved bowtie arm sections is achieved that the impedance matching at high frequency range can be improved while at the low frequency range a bit worse but still acceptable. So using different shapes of the Bowtie arms and cap, impedance matching at different frequency range can be emphasized.

A metal support element 5C is arranged between the ground plane 1C and the end portion 2C' of one of the bowtie arm sections $2C_2$, acting as a ground plane for a feeding line, inner conductor 7C, of a coax connection arranged in a metal conductor post 6C. The ground plane is provided with a hole or an opening 9C for the inner conductor 7C, and on the opposite side of the ground plane a coax connector 8C (cf. FIG. 3A) acting as an input antenna port is provided. The metal support element 5C may as described with reference to other embodiments be formed in one piece with, be integral with, the bowtie arm section $2C_2$ and connected to the ground plane 1C by means of any attachment means such as screws or bolts, rivets etc. or be fixed thereto by means of welding, soldering gluing or similar, and thus be either permanently secured or detachably secured thereto. The metal support element 5C may alternatively comprise a separate element adapted to be releasably or fixedly secured to the central portion of the end portion 2*c*' of the bowtie arm section $2C_1$ by means of fastening means as discussed above or by means of welding, soldering or similar.

The metal post 6C may have any appropriate cross section, such as circular, square shaped, rectangular, elliptic etc. as also discussed with reference to FIG. 1, and through appropriate selection of the shape and the size of the bowtie arm sections and of the cap, it becomes possible to obtain substantially equal radiation in the E-, and H-planes, if at issue, as also discussed earlier in the application.

As also referred to above, advantageously a feeding arrangement comprising a coaxial feeding line and a coaxial connector is used for frequencies up to about 90 GHz, or even up to about 110 GHz.

The bowtie arm sections and the caps are made of metal sheets, and for example a plastic support arrangement is used for supporting, arranging, the bowtie arm sections at a distance from the ground plane 1C and the cap 4C at a distance from the bowtie arm sections.

For millimeter waves, e.g. for frequencies above about 90, or above about 110 GHz, other feeding arrangements are preferably used, and PCB-technology or on wafer-technology etc. is advantageously used for providing support for the bowtie arm sections and the caps due to the small sizes at millimeter wave frequencies, more particularly above about 30 GHz, which is applicable for all embodiments discussed in this application.

Figure 3A:
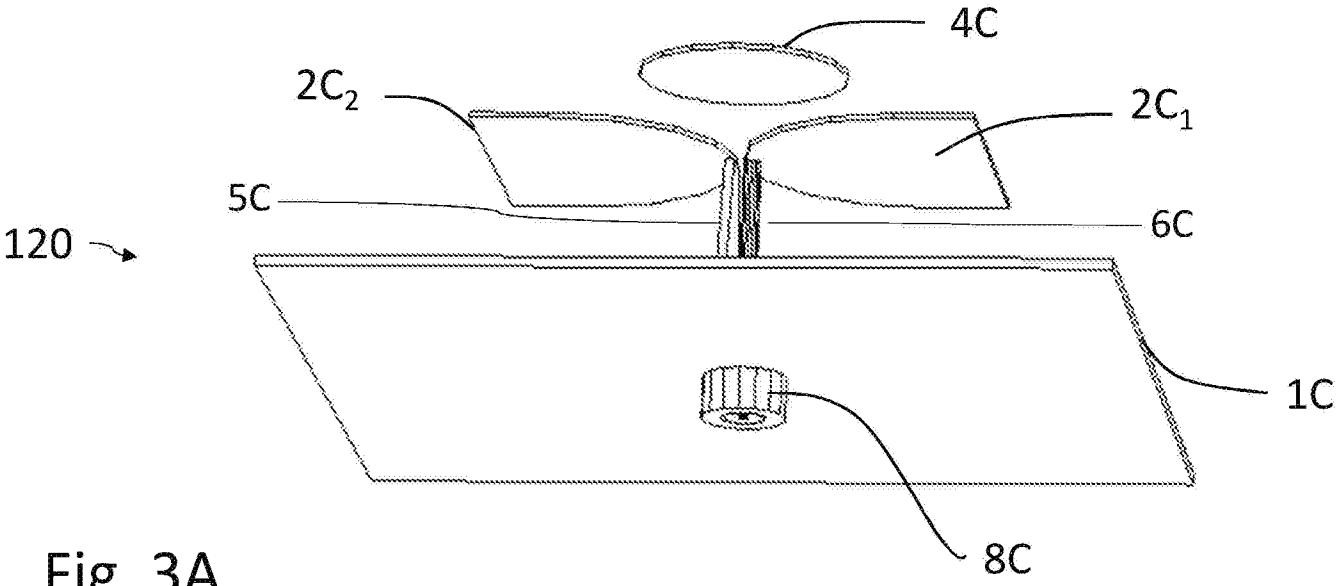
FIG. 3A is a schematic view in perspective from below of the antenna arrangement shown in FIG. 3.

FIG. 3A is a schematic view in perspective from below showing the antenna arrangement 120 of FIG. 3 with a coaxial connector 8C arranged on the side of the ground plane 1C opposite to the side where the bowtie arm sections are provided for feeding of the antenna arrangement. The other elements illustrated in FIG. 3A have already been discussed with reference to FIG. 3 and will not be further discussed here; reference is also made to the embodiment shown in FIGS. 1,1A.

Figure 4:
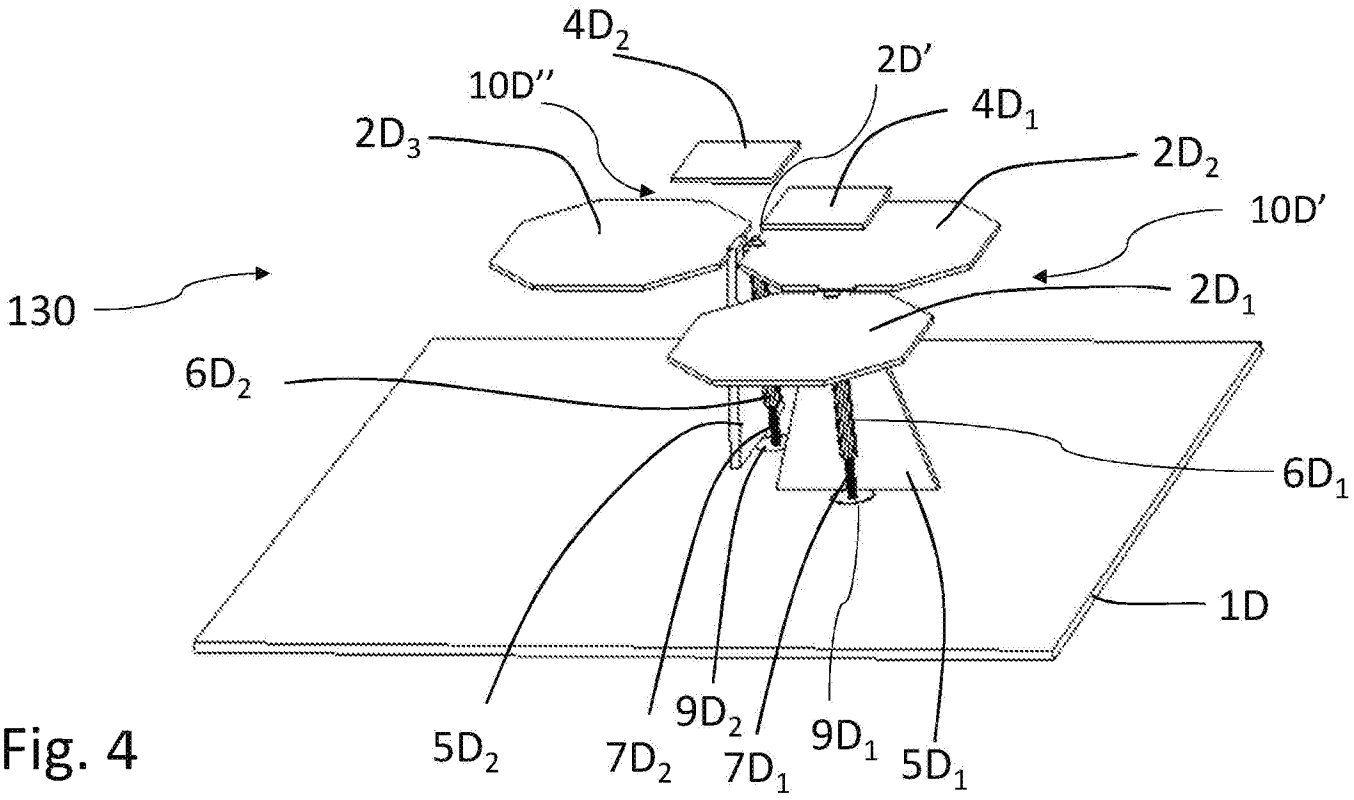
FIG. 4 shows still another embodiment of an antenna arrangement which is dual polarized.

FIG. 4 shows an embodiment comprising a dual polarized antenna arrangement 130.

It actually comprises two bowtie structures 10D',10D" each comprising two bowtie arm sections $2D_1$,$2D_2$;$2D_2$,$2D_3$ made of an electrically conducting material and which are arranged in a same plane, in this embodiment similar to the bowtie arm sections described with reference to the embodiment of FIG. 1. Also in other respects the antenna arrangement 130 is similar to the antenna arrangement 100 of FIG. 1, but with the difference that it comprises two polarizations instead of one. Similar elements already described with reference to FIG. 1 bear the same reference numerals but are indexed "D" and will therefore not be described in detail here. Also similar variation possibilities are to be covered also for arrangements which are not single polarized.

To provide for dual polarizations, the antenna arrangement 130 comprises three bowtie arm sections $2D_1$,$2D_2$,$2D_3$ of which one bowtie arm section bowtie $2D_2$ is common for the two bowtie structures 10D',10D". In this embodiment the bowtie arm sections $2D_1$,$2D_2$,$2D_3$ have a hexagonal shape. It should be clear that they might also have any other appropriate shape, triangular, square shaped, square shaped with cut outer corners, curved and/or discretely or continuously tapering towards the respective end portion 2D' facing another end portion etc. Through the use of a hexagonal shaped separation of elements (bowtie arm sections) is facilitated which is an advantage for dual polarized arrangements.

Thus, the antenna arrangement 130 comprises a metal ground plane 1D, three bowtie arm sections $2D_1$,$2D_2$,$2D_3$ located in a same plane at a same distance from the ground plane 1D. The bowtie arm sections $2D_1$,$2D_2$,$2D_3$ are held in place at the distance from the ground plane 1D by means of a supporting arrangement (not shown in FIG. 4), preferably a mechanical supporting arrangement comprising a common supporting element or separate supporting elements for each bowtie arm section $2D_1$,$2D_2$,$2D_3$ (see e.g. FIG. 4C). It should be clear that the invention is not limited to any particular supporting arrangement, but a supporting arrangement can be provided for in many different manners for keeping the bowtie arm sections at a desired distance from the ground plane 1D. In some embodiments the distance between the bowtie arm sections $2D_1$,$2D_2$,$2D_3$ and the ground plane 1D comprises about an eighth of the wavelength at the lower end frequency in a desired operation frequency band. It should be clear that, as in the other embodiments, the distance is not limited to an eighth of the wavelength at the lower end frequency band; it can be larger as well as smaller. The lower the desired lower end frequency, the larger the distance should be, and vice versa.

The end portions 2D',2D',2D', 2D' of two respective two bowtie arm sections $2D_1$,$2D_2$;$2D_2$,$2D_3$ facing each other and forming a respective bowtie structure 10D',10D" are located at a slight distance, e.g. less, or even much less than, about $\lambda/10$, $\lambda$ being the wavelength at the lower end frequency of the desired frequency band.

At a distance from, and in parallel with, the bowtie arm sections $2D_1$,$2D_2$,$2D_3$ two capping arrangements $4D_1$,$4D_2$ are located, which here comprise two substantially square shaped metal caps. The metal caps $4D_1$,$4D_2$ are located centralized with respect to the bowtie arm section end portions 2D',2D',2D',2D' facing one another and the distance between the bowtie arm sections $2D_1$,$2D_2$,$2D_3$ and the caps $4D_1$,$4D_2$ comprises about one sixteenth of the wavelength at the lower end frequency in a desired operation frequency band, and thus comprises about half the distance between the ground plane 1D and the bowtie arm section plane.

Each cap 4D,4D preferably comprises a patch symmetrically located in the direction of the longitudinal extension of the respective bowtie arm sections above which it is located, and may be square shaped, but also circular, rectangular or of any other appropriate shape and has a size substantially corresponding to about one eighth (diameter, side of square shaped patch/long side of a rectangle) of the wavelength at the lower end frequency in a desired operation frequency band.

A metal support element 5$D_1$ is arranged between the ground plane 1D and the end portion 2D' of bowtie arm section 2$D_2$, the main purpose of which being to act as a feeding line ground plane for a feeding line, here an inner conductor 7$D_1$ of a coax connection and being arranged in a metal conductor post 6$D_1$. The ground plane is provided with a hole or an opening 9$D_1$ through which the inner conductor 7$D_1$ passes, and on the opposite side of the ground plane a coax connector 8$D_1$ (cf. FIG. 4A) is provided acting as an input antenna port for a first polarization.

Similarly a metal support element 5$D_2$ is arranged between the ground plane 1D and the end portion 2D' of bowtie arm section 2$D_3$, the main purpose of which being to act as a feeding line ground plane for a feeding line, here an inner conductor 7$D_2$ of a coax connection being arranged in a metal conductor post 6$D_2$. The ground plane is provided with a hole or an opening 9$D_2$ through which the inner conductor 7$D_2$ passes, and on the opposite side of the ground plane a coax connector 8$D_2$ (cf. FIG. 4A) is provided acting as an input antenna port for a second polarization.

The metal support elements 5$D_1$,5$D_2$ may be formed in one piece with, integral with, the respective bowtie arm sections 2$D_2$,2$D_3$. A bent single piece of metal may then be used to form the respective bowtie arm section and the metal support element by being bent substantially 90° as discussed above with reference to FIG. 1. The metal support elements 5$D_1$,5$D_2$ may be connected to the ground plane 1D e.g. by means of any attachment means such as screws, bolts, rivets etc. or be fixed thereto by means of welding, soldering or similar, and thus be either permanently secured or detachably secured thereto. The metal support elements may also comprise separate elements adapted to be secured releasably or fixedly secured to the central portion of the respective end portion 2D' of the respective bowtie arm section by means of fastening means as discussed above or by means of welding, soldering or similar.

The metal conductor posts 6$D_1$,6$D_2$ may have any appropriate cross section, such as circular, square shaped, rectangular, elliptic etc.

Through appropriate selection of the shape and the size of the bowtie arm sections and of the caps, it becomes possible to obtain equal radiation in the E-, and H-planes as also discussed earlier in the application. The direction of the radiation may also be controlled or influenced in a desired manner through corresponding selection of shapes and sizes.

Thus, bowtie arm sections 2$D_1$,2$D_2$, cap 4$D_1$, support 5$D_1$, metal conductor post 6$D_1$, inner conductor 7$D_1$, hole 9$D_1$ are used for the first polarization, whereas bowtie arm sections 2$D_2$,2$D_3$, cap 4$D_2$, support 5$D_2$, metal conductor post 6$D_2$, inner conductor 7$D_2$, hole 9$D_2$ are used for the second polarization.

As referred to above, advantageously a feeding arrangement comprising two coaxial feeding lines and two coaxial connectors is used for frequencies up to about 90 GHz, or even up to about 110 GHz, or at least for microwave implementations.

As also discussed with reference e.g. to FIG. 1, for microwave implementations, the bowtie arm sections and the caps are made of metal sheets, and a plastic support arrangement is advantageously used for supporting, arranging, the bowtie arm sections at a distance from the ground plane 1D and the caps 4$D_2$,4$D_2$ at a distance from the bowtie arm sections.

Since all the elements, bowtie arm sections, caps etc. are planar, a dual polarized arrangement is provided which is very compact and which is easier to fabricate than hitherto known arrangements, and, in addition, since it can be fed using two coaxial connectors, the use of baluns or 180 hybrids is rendered superfluous, resulting in a better performance (UWB band) and a simpler geometry.

For millimeter waves, e.g. for frequencies above about 30, or above 90, or above about 110 GHz, other feeding arrangements need to, or are preferably used, and PCB-technology or on wafer-technology etc. is advantageously used for providing support for the bowtie arm sections and the caps due to the small sizes at mm-waves as also mentioned earlier in this application.

Figure 4A:
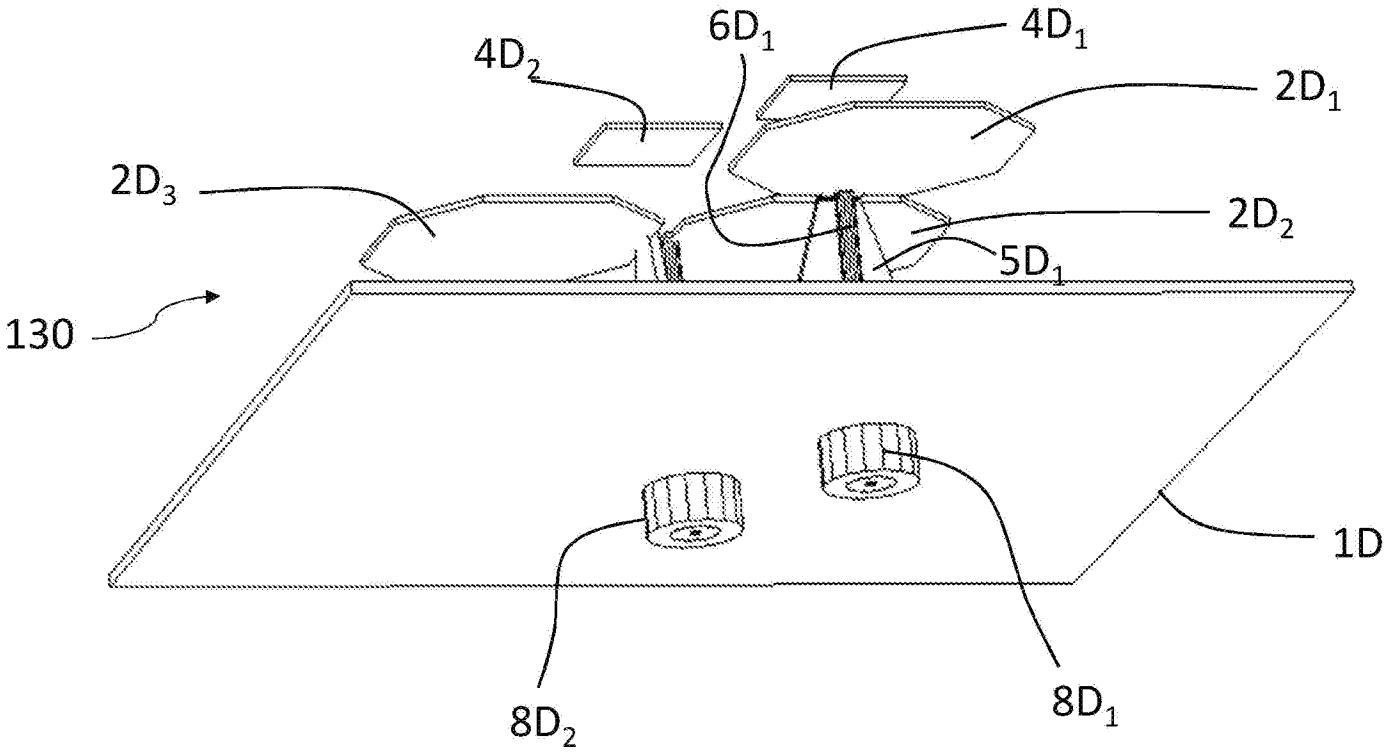
FIG. 4A is a schematic view in perspective from below of the dual polarized antenna arrangement shown in FIG. 4.

FIG. 4A is a perspective view taken from below of the arrangement 130 illustrating the coaxial connectors 8$D_1$,8$D_2$ disposed around the holes 9$D_1$,9$D_2$ on the other side of the ground plane 1D, i.e. opposite to the side where the bowtie arm sections etc. are located. The other elements have already been discussed with reference to FIG. 4 and will therefore not be further discussed here.

Figure 4B:
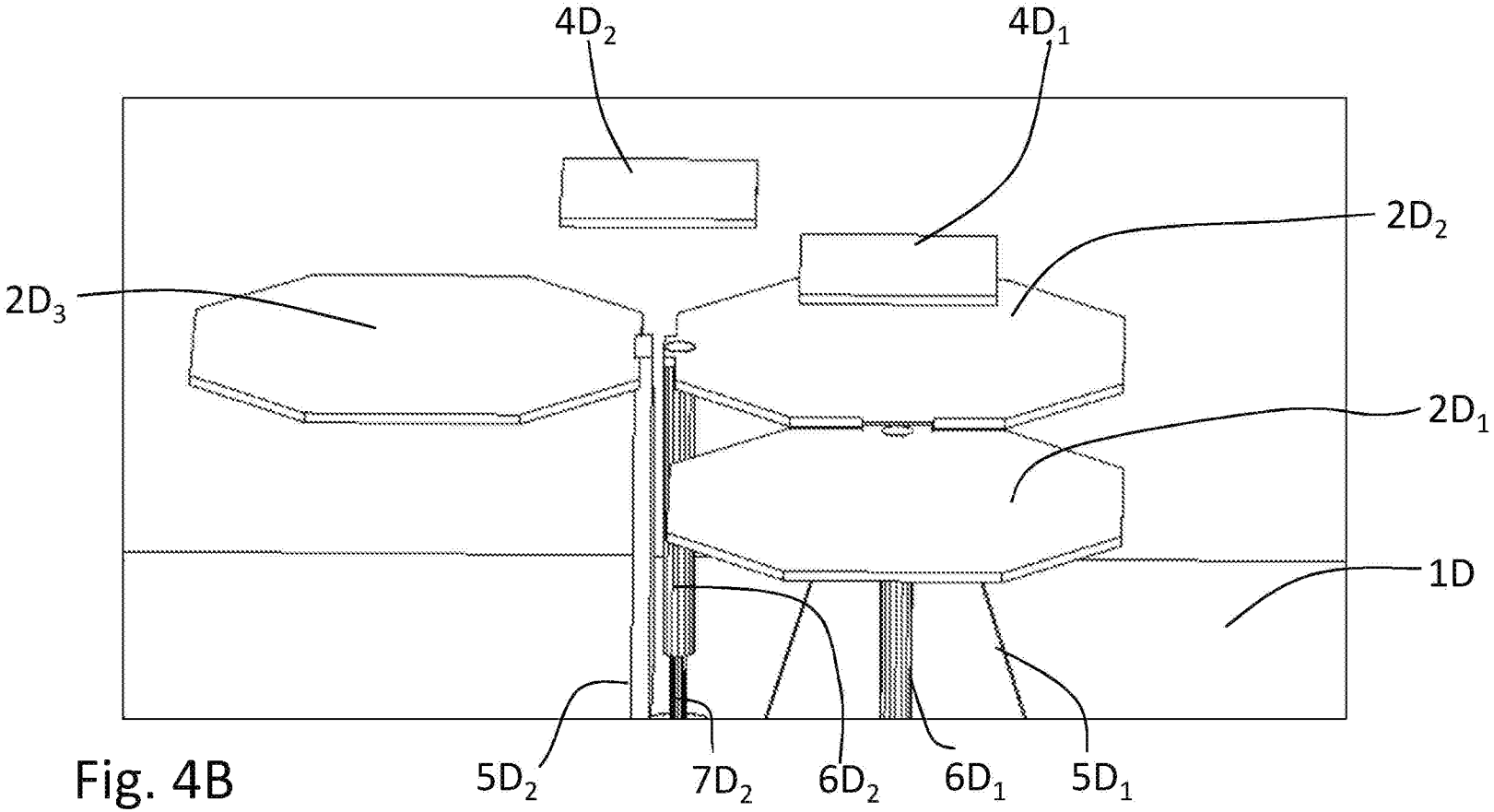
FIG. 4B is an enlarged view in perspective of the antenna arrangement of FIG. 4 showing three bowtie arms and two caps, supports and inner conductor somewhat more in detail.

FIG. 4B is an enlarged view of part of the antenna arrangement 100 shown in FIG. 4 showing the bowtie arm sections 2$D_1$,2$D_2$,2$D_3$, the metal support elements 5$D_1$,5$D_2$ acting as respective ground planes for the inner conductors 7$D_1$,7$D_2$ of the metal conductor posts 6$D_1$,6$D_2$ and being connected between the ground plane 1D and end portions 2D',2D' of the bowtie arm sections 2$D_2$,2$D_3$, and the metal conductor posts 6$D_1$,6$D_2$ connected to the center of the end portions 2D',2D' of the respective facing bowtie arm sections 2$D_1$,2$D_2$ more in detail. As referred to above the bowtie arm sections 2$D_1$,2$D_2$,2$D_3$ can have different flat shapes, continuously or discretely tapering towards an end portion, having a substantially semicircular end portion, may comprise end tips, may be straight, have the shape of hyperbolas, have an elliptic shape, be triangular or being stepped etc. The caps 4$D_1$,4$D_2$ are not shown in FIG. 4B.

Figure 4C:
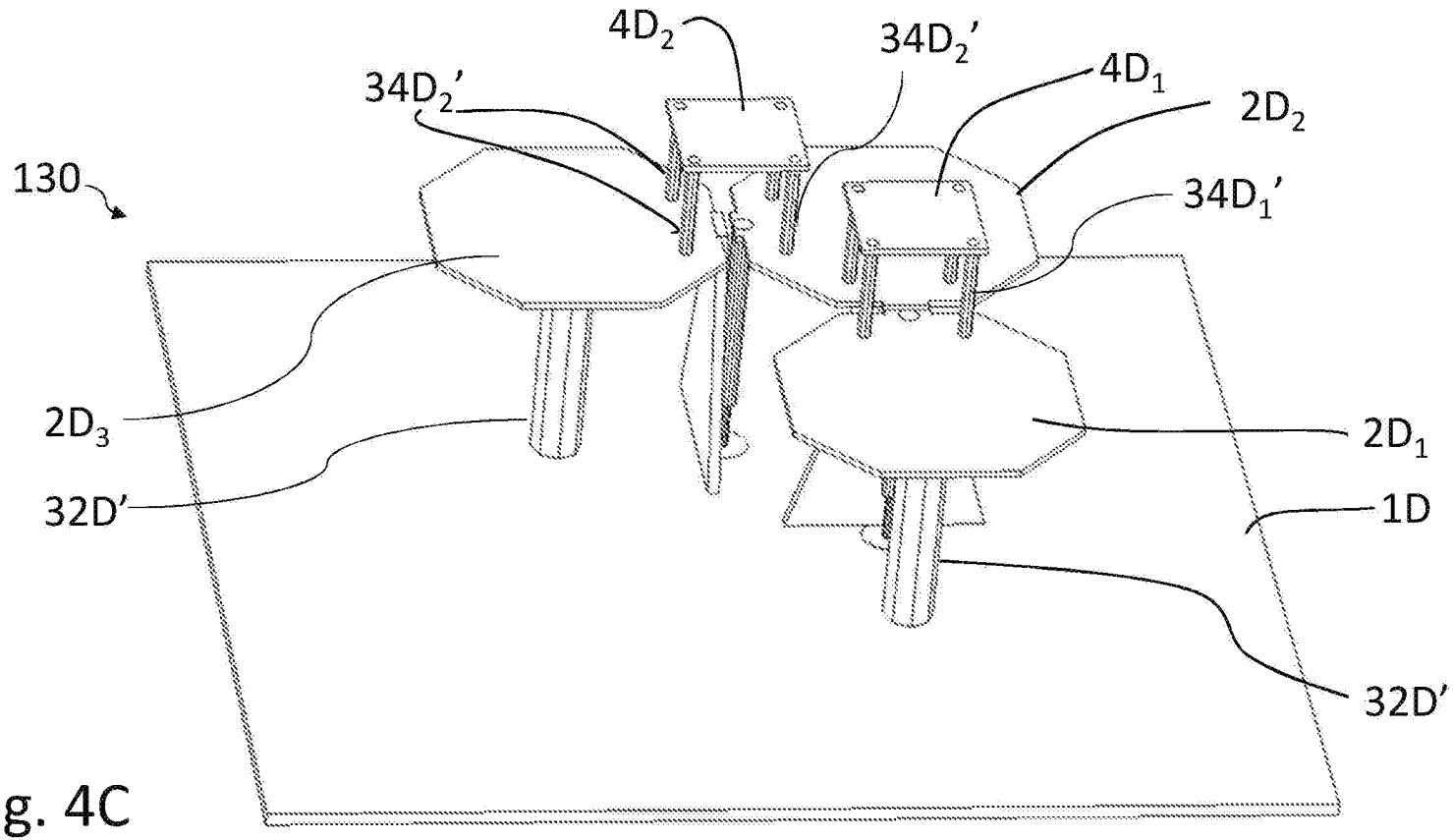
FIG. 4C is a view in perspective of the dual-polarized bowtie antenna arrangement of FIG. 4 with supporting elements according to one specific implementation.

In FIG. 4C an antenna arrangement 130 as in FIG. 4 with an exemplary supporting arrangement 10D is shown. The supporting arrangement 10D comprises a first supporting arrangement part with first arm section supporting means comprising three plastic posts 32D',32D' (only two shown in FIG. 4C) arranged to support the bowtie arm sections 2$D_1$,2$D_2$,2$D_3$ and a second supporting arrangement part with cap supporting means comprising a number of plastic posts for supporting each of the caps 4$D_1$,4$D_2$.

The bowtie arm sections 2$D_1$,2$D_2$,2$D_3$ rest on upper ends of the plastic posts 32D',32D', at a desired distance from the ground plane 1D. They are secured to the plastic posts 32D',32D' in any appropriate manner. In some embodiments the 2$D_1$,2$D_2$,2$D_3$ are provided with recesses adapted in cross-section and shape for reception of the posts, or it may be glued, welded or soldered on to the plastic posts. The second supporting arrangement part, the cap supporting means, here comprises four plastic posts 34$D_1$',34$D_1$',34$D_1$', 34$D_1$' arranged to support cap 4$D_1$ onto the first and second bowtie arm sections 2$D_1$,2$D_2$, and four plastic posts 34$D_2$', 34$D_2$',34$D_2$',34$D_2$' arranged to support cap 4$D_2$ onto the second and third bowtie arm sections 2$D_2$,2$D_3$. The plastic posts arranged to support the caps are so disposed that, for each cap, two plastic posts are disposed on one of the bowtie arm sections above which the respective cap is to be held at a certain distance, and two plastic posts are disposed on the other bowtie arm section above which the respective cap is disposed, i.e. there are four cap supporting plastic posts for each bowtie structure. It should however be clear that a supporting arrangement can take many different forms and comprise separate elements for supporting the bowtie arm sections and the caps, or a common arrangement for supporting all or some of the bowtie arm sections or even a common arrangement, or structure, for supporting a number of bowtie arm sections as well as one or more caps. The number of plastic posts may also be different, e.g. there may be more than one plastic post for each bowtie arm section and/or fewer plastic posts for each cap, also depending for example on the shape of the cap.

In other respects the elements of the arrangement 130 have already been discussed with reference to FIGS. 4, 4A, 4B and will therefore not be further discussed here.

Figure 4D:
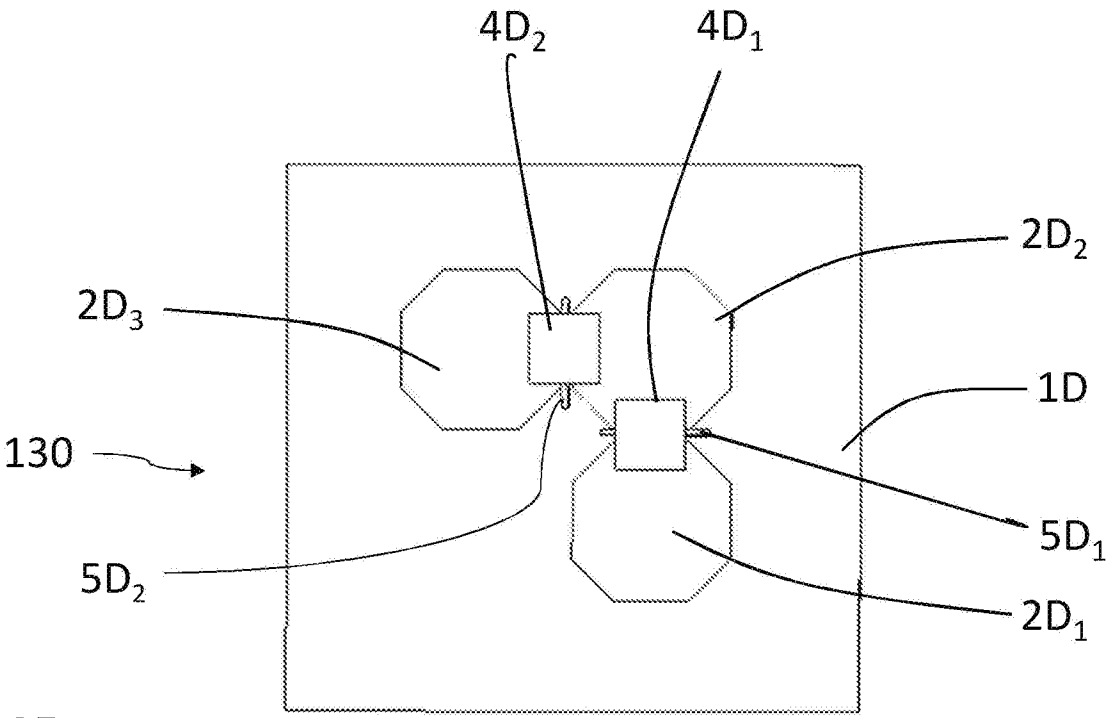
FIG. 4D is a schematic top view of the antenna arrangement of FIG. 4.

FIG. 4D is a schematic top view of the antenna arrangement 130 illustrating how the caps $4D_1$,$4D_2$ are disposed above the bowtie arm sections $2D_1$,$2D_2$,$2D_3$. Since all the elements already have been discussed with reference to FIGS. 4,4A,4B,4C, they will not be further discussed here.

Figure 5:
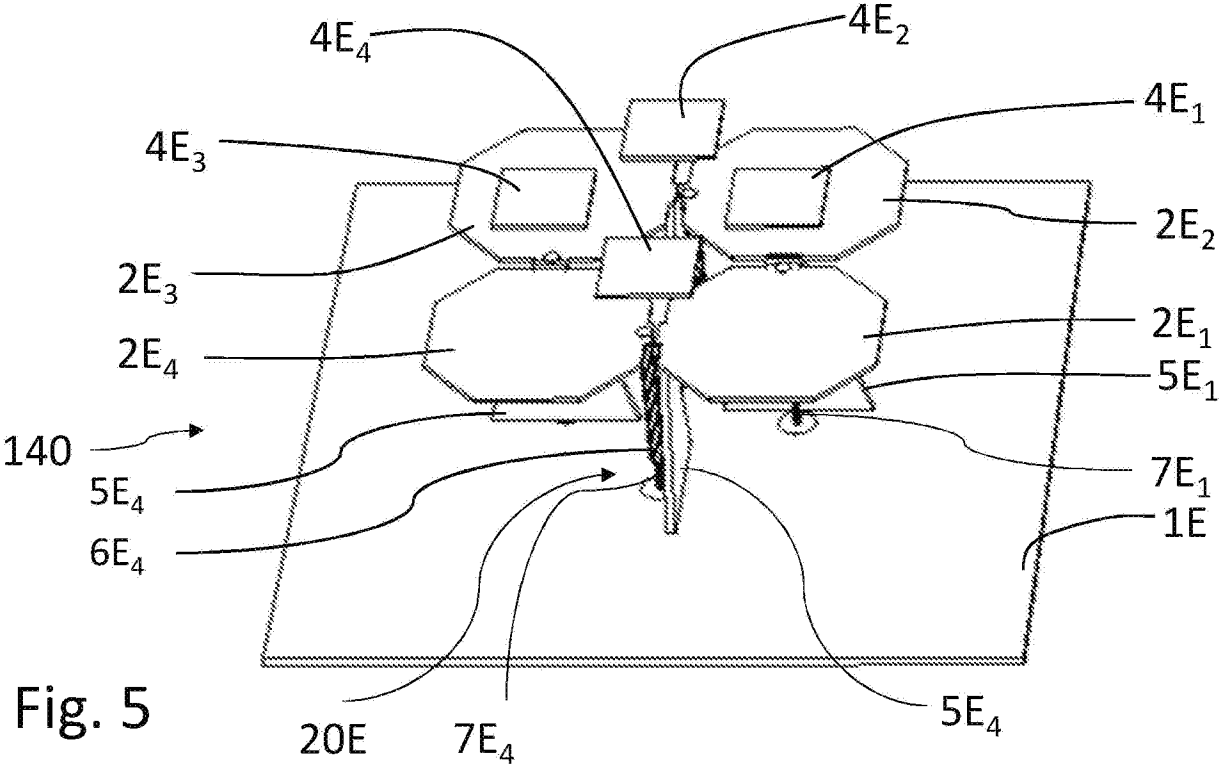
FIG. 5 is a view in perspective of a 2×2 bowtie antenna array for a dual polarized MIMO antenna.

FIG. 5 shows an embodiment comprising a dual polarized antenna arrangement 140 comprising a 2×2 array for a dual polarization MIMO antenna. Four capped bowties, or two bowtie structures each comprising two bowtie arm sections, are according to the invention used to provide the 2×2 dual polarized array.

The antenna arrangement 140 comprises a common ground plane 1E and four bowtie structures 10E',10E",10E"', 10E"", each comprising two bowtie arm sections $2E_1$,$2E_2$; $2E_2$,$2E_3$;$2E_3$,$2E_4$;$2E_4$,$2E_1$ made of an electrically conducting material and arranged in a same plane at a distance above the ground plane 1E as also described more thoroughly with reference to the preceding embodiments. Similar considerations and alternations are applicable also with respect to the antenna arrangement 140 as far as materials, distances, shapes etc. are concerned and will therefore not be further discussed herein. The antenna arrangement 140 comprises a 2×2 array and two polarizations formed by bowtie arm sections, caps, ground plane etc. similar to those described earlier, e.g. with reference to FIG. 1, and similar elements bear the same reference numerals but are indexed "E" and will therefore not be described in detail here, except as far as features and properties relevant for this particular embodiment are concerned. The antenna arrangement 140 comprises four bowtie arm sections $2E_1$,$2E_2$,$2E_3$,$2E_4$, wherein each of the bowtie arm sections $2E_1$,$2E_2$,$2E_3$,$2E_4$ form part of two bowtie structures, i.e. each bowtie arm section $2E_1$,$2E_2$,$2E_3$,$2E_4$ can be said to be reused for two capped bowtie structures. The four bowtie arm sections $2E_1$,$2E_2$,$2E_3$,$2E_4$ here have hexagonal shapes and are arranged symmetrically around a center of symmetry at the desired distance from the ground plane 1E, each with two orthogonally disposed end portions 2E',2E' arranged to face the end portions 2E',2E' of another respective bowtie arm section disposed in parallel therewith and at a slight distance from each other as also described with reference in particular to FIG. 1 and FIG. 4. It should be clear that also bowtie arm sections having any other appropriate shape, square shaped, square shaped with cut outer corners, curved and/or discretely or continuously tapering towards the respective end portion 2E' facing another end portion etc. can be used, although hexagonally shaped bowtie arm sections are very advantageous for dual polarization antenna arrangements for purpose of among other things separation of elements.

Thus, the antenna arrangement 140 comprises a metal ground plane 1E, four bowtie arm sections $2E_1$,$2E_2$,$2E_3$,$2E_4$ located in a plane and at a same distance from the ground plane 1E.

The bowtie arm sections $2E_1$,$2E_2$,$2E_3$,$2E_4$ are held in place at the distance from the ground plane 1E by means of a supporting arrangement (not shown in FIG. 5), preferably a mechanical supporting arrangement e.g. similar to the supporting arrangement described with reference to FIG. 4C, but adapted to support four bowtie arm sections and four caps. It should be clear that the invention is not limited to any particular supporting arrangement, but a supporting arrangement can be provided for in many different manners for keeping the bowtie arm sections in a plane located at a desired distance from the ground plane 1E and the caps at a desired distance from the bowtie arm sections. In some embodiments the distance between the bowtie arm sections and the ground plane 1E comprises about an eighth of the wavelength at the lower end frequency in a desired operation frequency band. It should be clear that also for this embodiment the distance is not limited to an eighth; it can be larger as well as smaller. The lower the desired lower end frequency, the larger the distance should be, and vice versa.

The end portions 2E', . . . , 2E' of two respective two bowtie arm sections facing each other and forming a respective bowtie structure 10E', . . . , 10E"" are located at a slight distance, e.g. less than about $\lambda/10$, $\lambda$ here being the wavelength at the lower end frequency of the desired frequency band.

At a distance from the bowtie arm sections $2E_1$,$2E_2$,$2E_3$, $2E_4$, in parallel with the bowtie arm section plane, four capping arrangements $4E_1$,$4E_2$,$4E_3$,$4E_4$ are located, which here comprise four substantially square shaped metal caps. The metal caps $4E_1$,$4E_2$,$4E_3$,$4E_4$ are located symmetrically with respect to the bowtie arm section end portions 2E', . . . , 2E' facing one another and the distance between the bowtie arm sections $2E_1$,$2E_2$,$2E_3$,$2E_4$ and the caps $4E_1$, $4E_2$,$4E_3$,$4E_4$ comprises about one sixteenth of the wavelength at the lower end frequency in a desired operation frequency band, and thus comprises about half the distance between the ground plane 1E and the bowtie arm section plane.

Each cap $4E_1$,$4E_2$,$4E_3$,$4E_4$ preferably comprises a symmetrically located patch, at least in the direction along the longitudinal extension of the respective bowtie arm sections above which it is located, and may be square shaped, but also circular, rectangular or of any other appropriate shape and has a size substantially corresponding to about one eighth (diameter, side of square shaped patch/long side of a rectangle) of the wavelength at the lower end frequency in a desired operation frequency band.

A metal support element $5E_1$,$5E_2$,$5E_3$,$5E_4$ is arranged between the ground plane 1E and an end portion 2E' of a respective bowtie arm section $2E_1$,$2E_2$,$2E_3$,$2E_4$, the main purpose of which being to act as feeding line ground planes for a respective feeding line, here inner conductors $7E_1$,$7E_2$, $7E_3$,$7E_4$, of coax connections and being arranged in a respective metal conductor post $6E_1$,$6E_2$,$6E_3$,$6E_4$ as discussed with reference to e.g. the embodiments shown in FIG. 1 and FIG. 4. The ground plane is provided with four holes or openings $9E_1$,$9E_2$,$9E_3$,$9E_4$, through which the inner conductors $7E_1$,$7E_2$,$7E_3$,$7E_4$ pass, and on the opposite side of the ground plane 1E four corresponding coax connectors are provided (cf. FIG. 4A) acting as input antenna ports for a first and a second polarization. The bowtie arm sections $2E_1$,$2E_2$ and cap $4E_1$ form bowtie structure 10E' with a first, same, polarization as the bowtie structure 10E"' formed by bowtie arm sections $2E_3$,$2E_4$ and cap $4E_3$, whereas the bowtie structure 10E" formed by bowtie arm sections $2E_2$, $2E_3$ and cap $4E_2$ and bowtie structure 10E"" formed by bowtie arm sections $2E_4$,$2E_1$ and cap $4E_4$ are of a second, orthogonal, polarization. One port may thus be used for a horizontal polarization and one port for a vertical polarization.

As discussed earlier in the application, the metal support elements may be formed in one piece with, integral with, the respective bowtie arm sections to be connected to the ground plane 1E e.g. by means of any attachment means such as screws, bolts or rivets etc. or be fixed thereto by means of welding, soldering, gluing or similar, and thus be either permanently secured or detachably secured thereto, or as separate elements adapted to be secured releasably or fixedly secured to the respective bowtie arm section by means of fastening means as discussed above or by means of welding, soldering or similar.

Also the metal conductor posts $\mathbf{6}E_1,\mathbf{6}E_2,\mathbf{6}E_3,\mathbf{6}E_4$ may have any appropriate cross section, such as circular, square shaped, rectangular, elliptic etc.

Most advantageously feeding arrangements comprising coaxial feeding lines and coaxial connectors are used, at least for frequencies up to about 90 GHz, or even up to about 110 GHz, or at least for microwave implementations, but the invention is not limited thereto.

Through an antenna arrangement 140 wherein among other things the bowtie arm sections are reused such that each one forms part of two bowtie structures, in addition to the fact that flat metal elements etc. as discussed with reference to the preceding embodiments, are used, and the particular arrangement of the bowtie arm sections and caps as described herein, a very compact 2×2 array is provided which also has a high radiation efficiency (low mutual coupling between the elements) which is extremely advantageous.

It should be clear that the invention can be varied in a number of ways. The bowtie arm sections, or antenna elements, and the caps are preferably made of a conductive material comprising metal, e.g. Cu, Al, or a material with similar properties, or an alloy.

Alternative feeding arrangements can be used, above 90 GHz or 110 GHz baluns or 180° hybrids (a balun realized as a separate circuit) may be used, also for lower frequencies such feeding arrangements can be used e.g. for making a transition from two balanced feed points to a single-ended port comprising a single coaxial cable or a microstrip line, although then the complexity is increased, and it is an advantage that coaxial connectors can be used instead as discussed above. The balun or 180° circuit must in such case be realized at the back side of the ground plane or a PCB, or at a part of the front side of a ground plane or a PCB where it does not interact with the performance of the bowtie antenna arrangement itself. Two ports can then be differentially excited, providing an antenna arrangement comprising a one-port antenna with a single linear polarization.

In alternative embodiments any connectors, preferably coaxial connectors, or in some embodiments baluns or 180 hybrids, may be provided for and arranged in any desired manner, and the ports may comprise coaxial connectors with centre conductors that connect microstrip transmission lines and/or baluns to respective conducting elements, said coaxial connectors, microstrip lines and/or baluns being arranged on the back (or front) side of the conducting ground plane or the PCB.

Different numbers of bowtie arm sections can be arranged on a ground plane, or a PCB, in different manners, and provide antenna arrangement with different numbers of ports, e.g. a number of differentially excited ports or a number of independently excited ports etc. The size of a 2×2 bowtie antenna arrangement according to the present invention typically comprises one third of wavelength at the low end frequency, which is smaller than a normal size of an UWB antenna (half wavelength).

Figure 6:
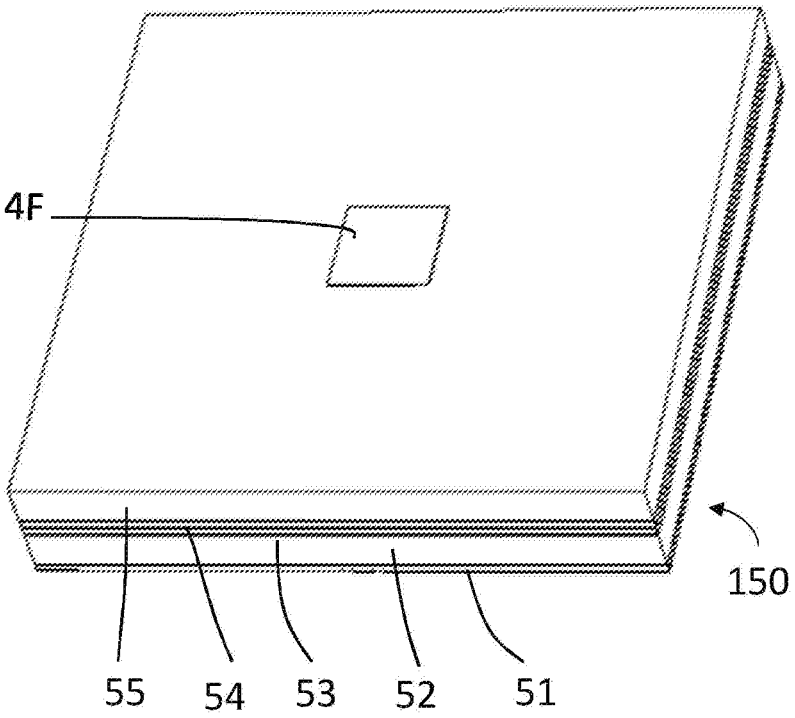
FIG. 6 is a view in perspective of a bowtie antenna arrangement suitable for mm-wave applications.

FIG. 6 shows an embodiment of a bowtie antenna arrangement 150 comprising a multilayer capped bowtie antenna. It here comprises one bowtie structure comprising two bowtie arm sections 542,542,542',542' (see FIG. 6F) made of an electrically conducting material which are arranged in a bowtie arm section plane, as discussed with reference to the preceding embodiments. The bowtie antenna arrangement 150 is particularly suitable for millimeter waves, e.g. for frequencies above about 30, or above 90 or 110 GHz, and therefore an appropriate feeding arrangement is used, and a multilayer PCB-structure, here comprising five layers is used for providing support for the bowtie arm sections and the caps due to the extremely small sizes at millimeter waves. The bottom layer 51 is denoted a first layer, followed by a second layer 52, a third layer 53, a fourth layer 54 and a fifth layer 55 on which a cap 4F of a conducting material, e.g. of metal, is arranged.

Figure 6A:
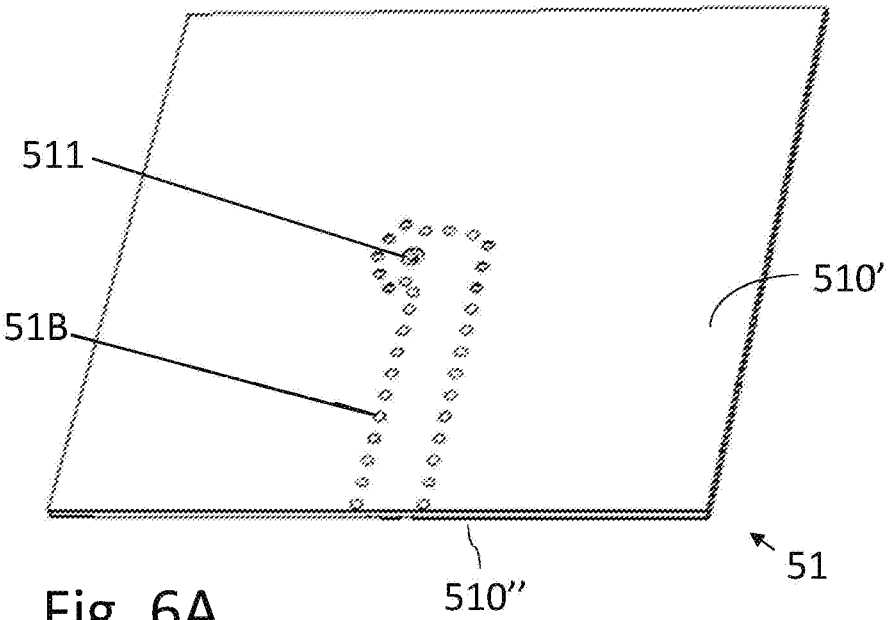
FIG. 6A shows an upper metal sheet of a first layer of the arrangement shown in FIG. 6.

The first layer 51 comprises an upper metal sheet 510' and a lower metal sheet 510" arranged on opposite sides of a substrate. FIG. 6A shows the upper side of the first layer 51, comprising the metal sheet 510 disposed on the PCB substrate 510''' (see FIG. 6C), a plurality of via holes 51B forming a coplanar waveguide, and a via hole 511 in the metal sheet 510 for feeding by means of a through going via 544 (not shown in FIG. 6A; cf. FIG. 6I).

Figure 6B:
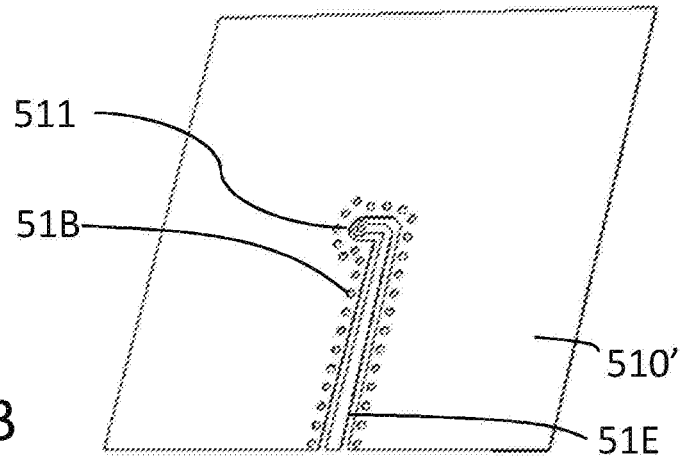
FIG. 6B shows a lower metal sheet of the first layer of the arrangement in FIG. 6.

FIG. 6B shows the lower metal sheet 510" of the first layer 51 of the PCB board, with a corresponding plurality of metal sheet interconnecting via holes 51B and a microstrip line 51D forming a coplanar waveguide and a corresponding via hole 511 for feeding.

Figure 6C:
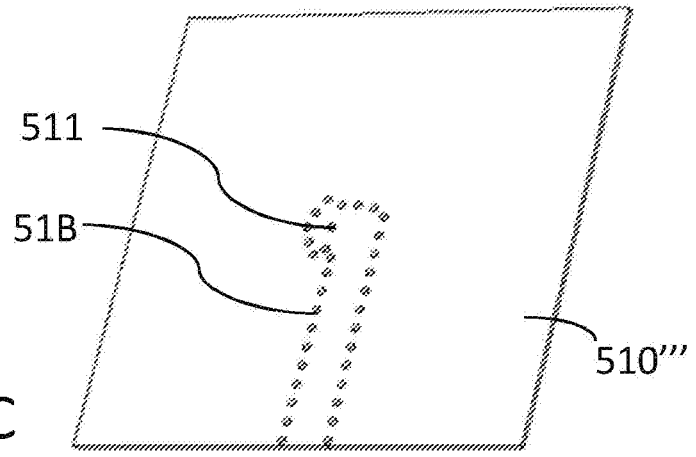
FIG. 6C shows the substrate of the first layer shown in FIG. 6.

FIG. 6C shows the substrate 510''' of the first layer 51 disposed between the upper metal sheet 510' and the lower metal sheet 510", also comprising corresponding via holes 51B,511.

Figure 6D:
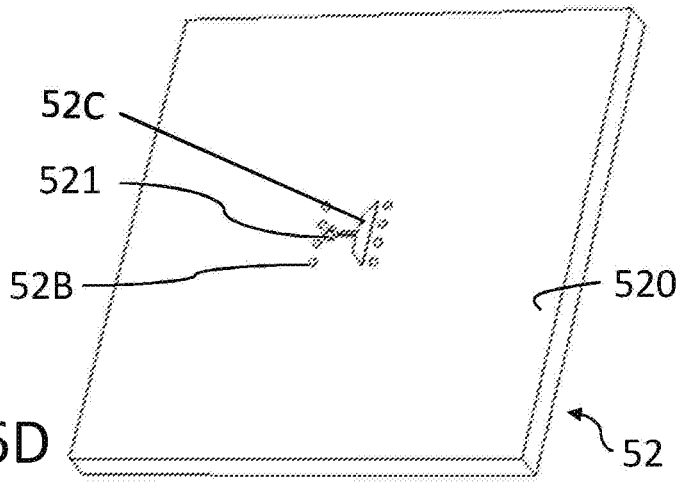
FIG. 6D shows an example of a second layer of an arrangement as in FIG. 6.

FIG. 6D shows the second layer 52 of the bowtie antenna arrangement 150 in FIG. 6. The second layer 52 comprises a substrate layer 520, a T-shaped metal line patch 52C, via holes 52B and a via hole 521 for a through going feeding via.

Figure 6E:
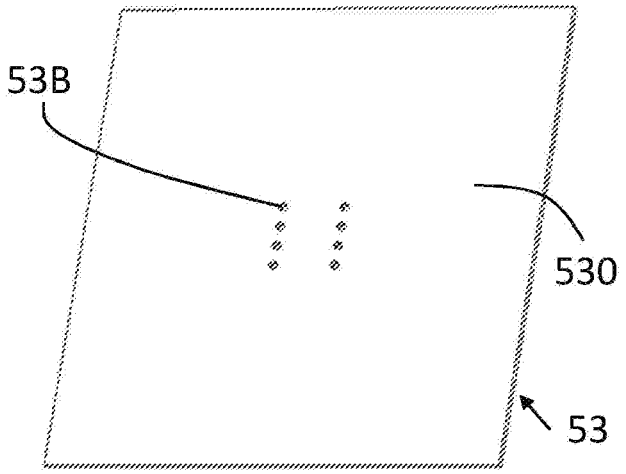
FIG. 6E shows an example of a third layer of an arrangement as in FIG. 6.

FIG. 6E shows the third layer 53 of the bowtie antenna arrangement 150, which is made of only a substrate 530 with corresponding via holes 53B, 531.

Figure 6F:
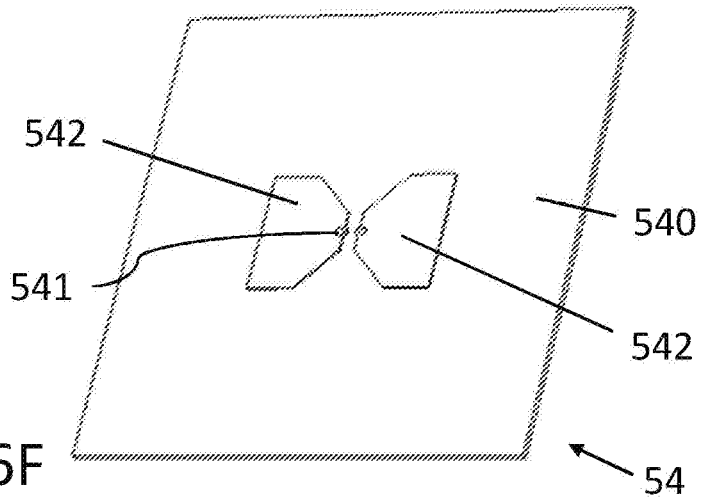
FIG. 6F shows the fourth layer of the arrangement of FIG. 6.
Figure 6G:
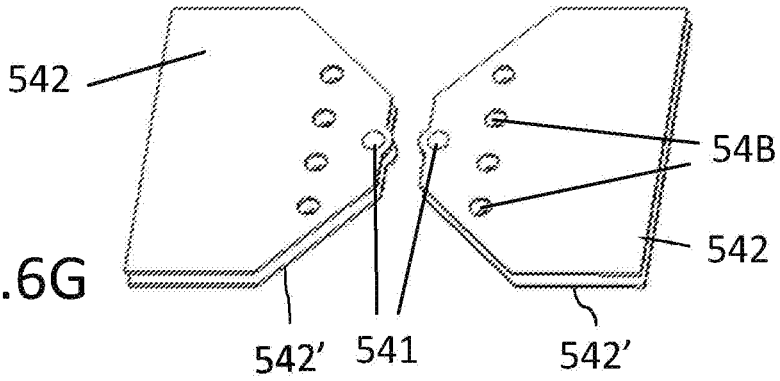
FIG. 6G shows the fourth layer of FIG. 6F with the substrate removed, FIG. 6H schematically illustrates bonding between the first and the fourth layers of the arrangement of FIG. 6.
Figure 6H:
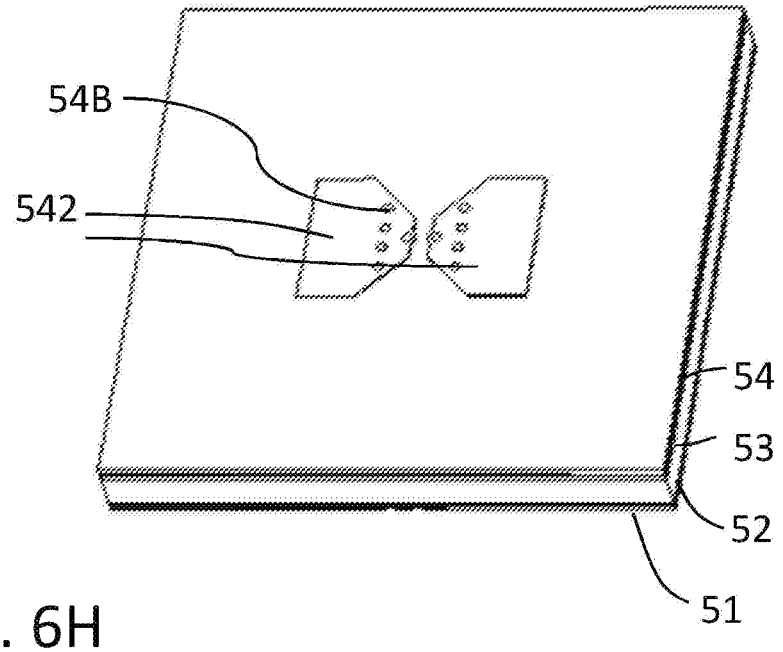
FIG. 6I illustrates bonding between the first and fourth layers as in FIG. 6H but with all substrates removed.
Figure 6I:
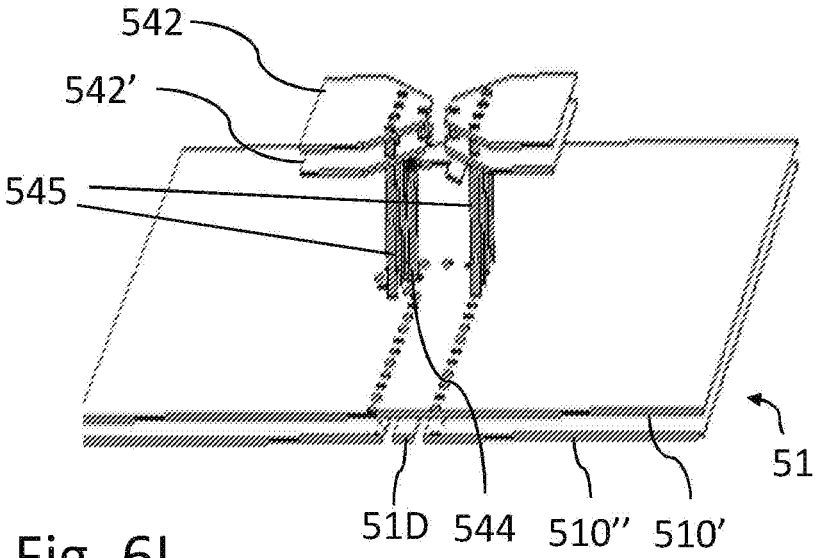

FIG. 6F shows the fourth layer 54 which comprises a substrate 540, bowtie arm sections 542,542 and via holes 54B,54B for interconnecting upper bowtie arm sections 542,542 with lower bowtie arm sections 542',542' arranged on under the substrate 540 (see FIG. 6G), and via holes 541,541 for through going feeding vias 544 (see FIG. 6I).

FIG. 6G shows the fourth layer 54 with the substrate 540 hidden or removed in order to illustrate the bowtie arm sections 542,542 located on the upper side and the bowtie arm sections 542',542' located on the lower side of the substrate 540, and the via holes 54B for vias interconnecting respective upper and lower bowtie arm sections 542,542; 542',542'. It also shows the via holes 541,541 for the through going vias, There may also be more via holes for vias through the fourth layer 54 to the first layer 51 to still further improve the performance.

FIG. 6H schematically illustrates the bonding from the fourth layer 54 to the first layer 51. Elements which already have been discussed bear the same reference numerals as above and will not be further discussed here.

FIG. 6I schematically illustrates the bonding of the fourth layer 54 to the first layer 51 with all substrates hidden or removed in order to illustrate the geometry more clearly, and showing the through going feeding vias 544 where, in addition, additional through vias 544 are provided which serve the purpose of further improving the performance. Elements which already have been discussed bear the same reference numerals as above and will not be further discussed here.

Thus, through bonding the fifth layer 55 comprising a substrate with a conducting, e.g. of metal, or metallized, cap 4F (see FIG. 6) to the sub-bonded layer structure comprising layers 51-54, a multi-layer capped bowtie antenna arrangement 150 is provided.

Figure 7:
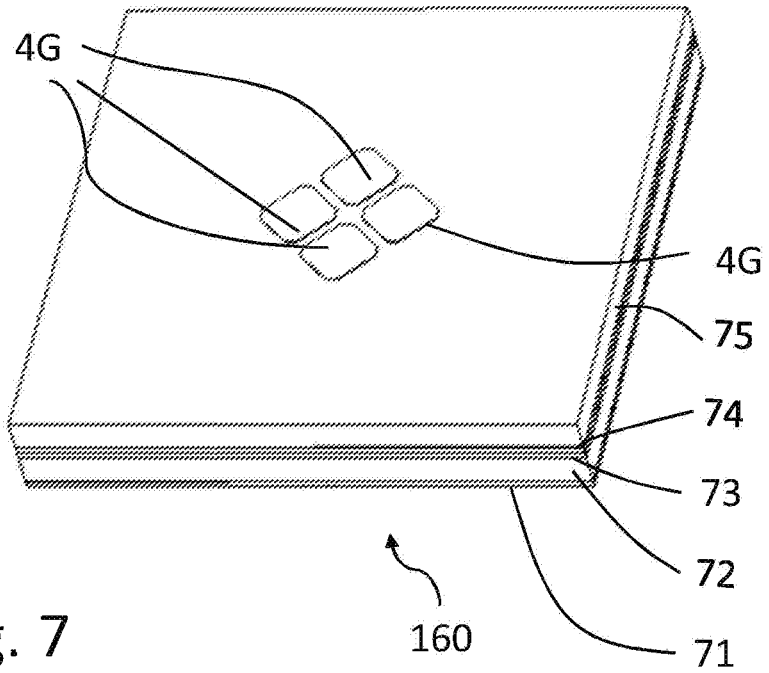
FIG. 7 is a view in perspective of an alternative embodiment of a bowtie antenna arrangement suitable for mm-wave applications.

FIG. 7 shows still another embodiment of a bowtie antenna arrangement 160 comprising a multilayered capped bowtie antenna structure particularly suitable for millimeter wave applications. It here comprises a multiple PCB structure comprising a 2×2 array. The multilayer PCB-structure comprises five layers, a first, bottom, layer 71, a second layer 72, a third layer 73, a fourth layer 74 and a fifth layer 75 on which four caps 4G are disposed, and comprising four bowtie structures.

Figure 7A:
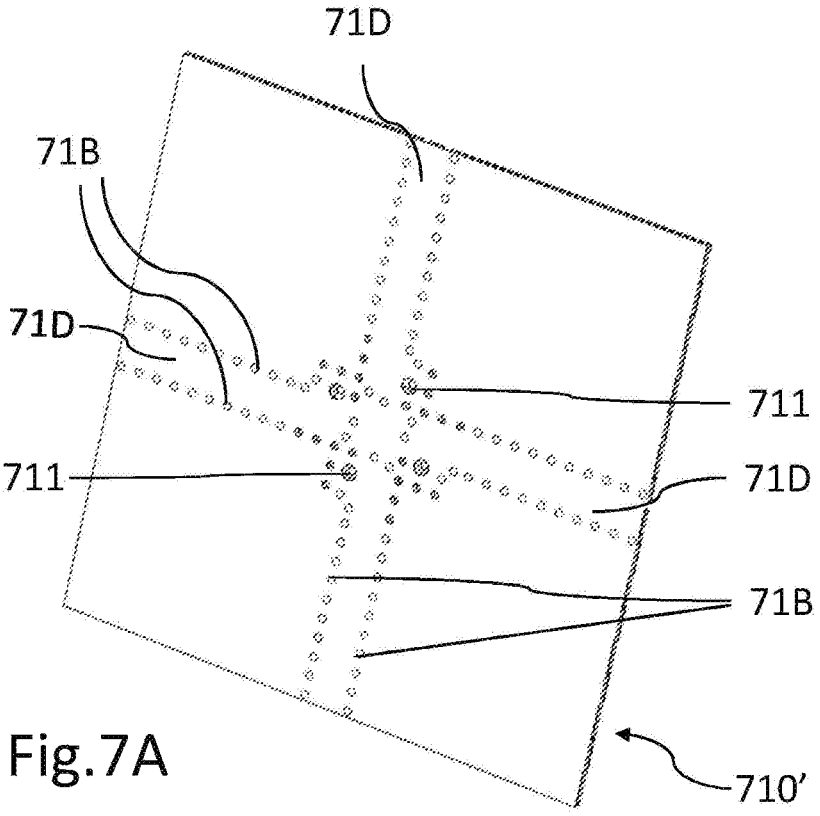
FIG. 7A shows an upper metal sheet of a first layer of the arrangement shown in FIG. 7.

The first layer 71 comprises an upper metal sheet 710, a lower metal sheet 710" arranged on opposite sides of a substrate. FIG. 7A shows the upper side of the first layer 71 comprising the upper metal sheet 710' disposed on the PCB substrate 710'" (FIG. 7C), a plurality of via holes 71B arranged such as to form four coplanar waveguides 71D, and four via holes 711 for via feeding of each a respective antenna element formed by a bowtie structure.

Figure 7B:
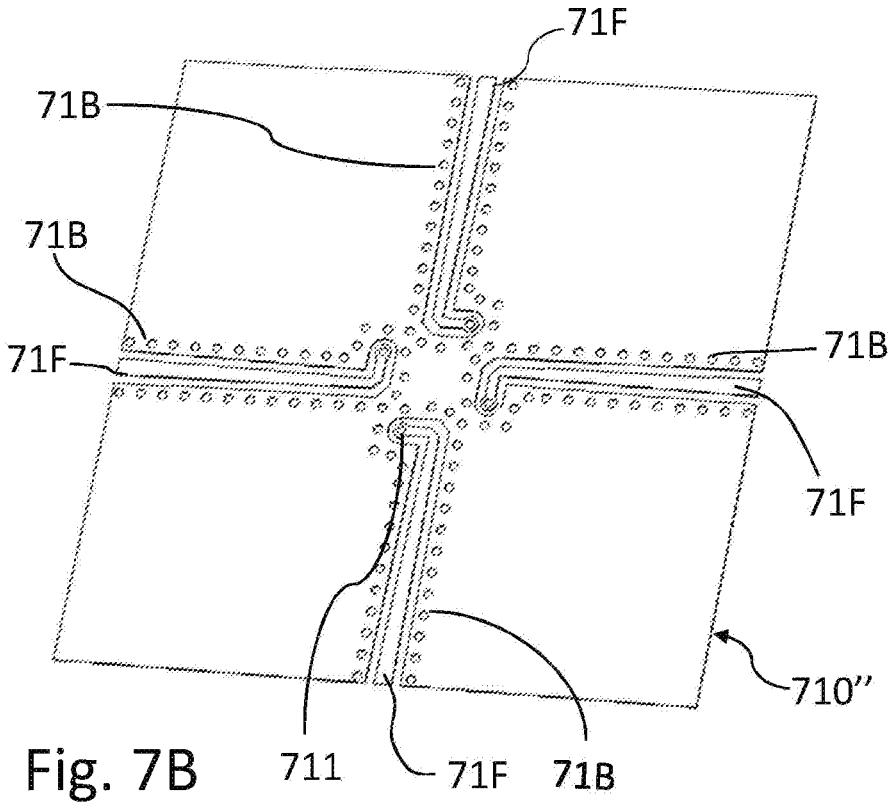
FIG. 7B shows a lower metal sheet of the first layer of the arrangement in FIG. 7.

FIG. 7B shows the lower side of the first layer 71 comprising the lower metal sheet 710" disposed on the PCB substrate 710'" (FIG. 7C), a plurality of via holes 71B and four microstrip lines 71F arranged such as to form four coplanar waveguides 71D.

Figure 7C:
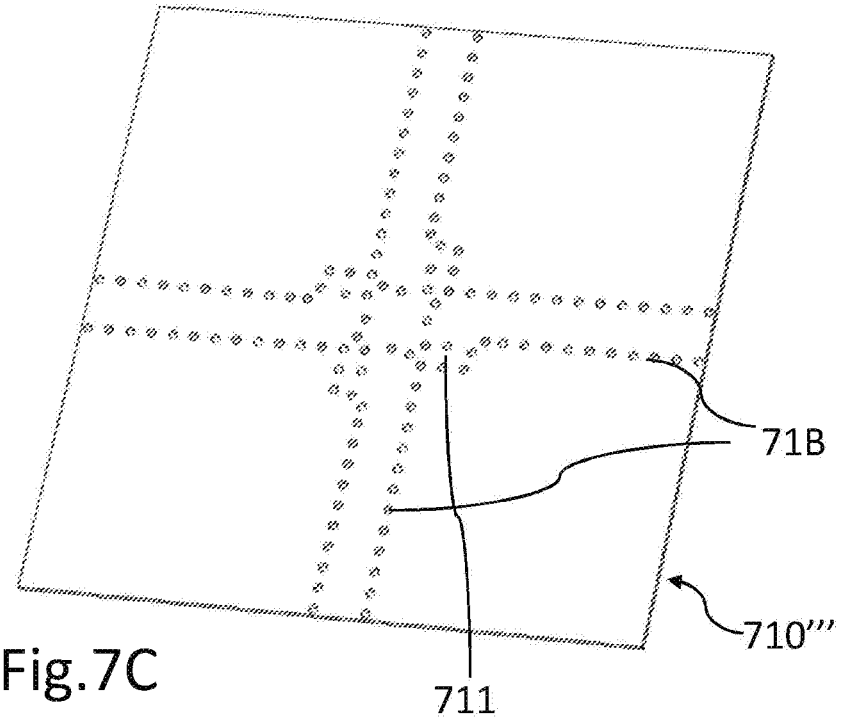
FIG. 7C shows the substrate of the first layer shown in FIG. 7.

FIG. 7C shows the substrate 710'" of the first layer 71, also with a plurality of corresponding via holes 71B for interconnection of the upper and lower sheets 710',710", and feeding via holes 711.

Figure 7D:
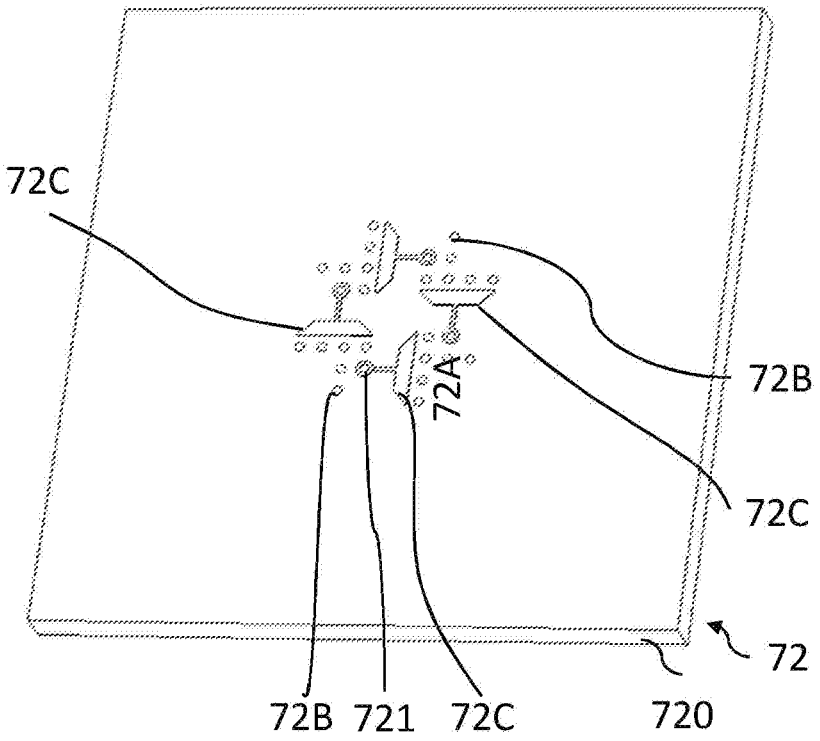
FIG. 7D shows an example of a second layer of an arrangement as in FIG. 7.

FIG. 7D shows the second layer 72 of the bowtie antenna arrangement 160. The second layer 72 comprises a substrate layer 720, four (here) T-shaped metal line excitation patches 72C, one for each of the four antenna elements formed by the bowtie arm sections, and a plurality of via holes 72B, 721.

Figure 7E:
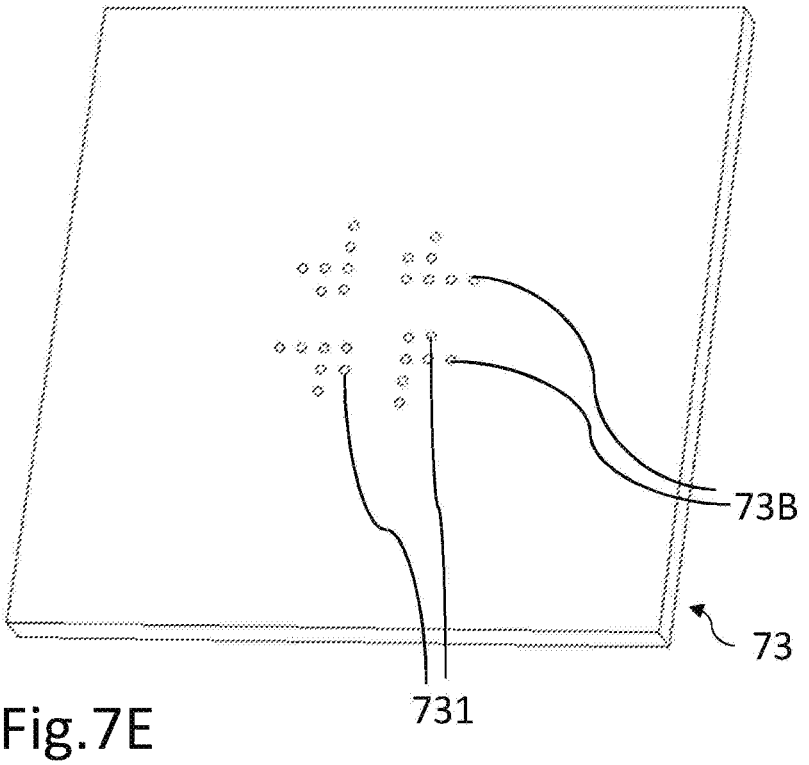
FIG. 7E shows an example of a third layer of an arrangement as in FIG. 7.

FIG. 7E shows the third layer 73 of the bowtie antenna arrangement 160. The third layer 73 only comprises a substrate with a plurality of via holes 73B,731, wherein via holes 731 are for through going feeding vias.

Figure 7F:
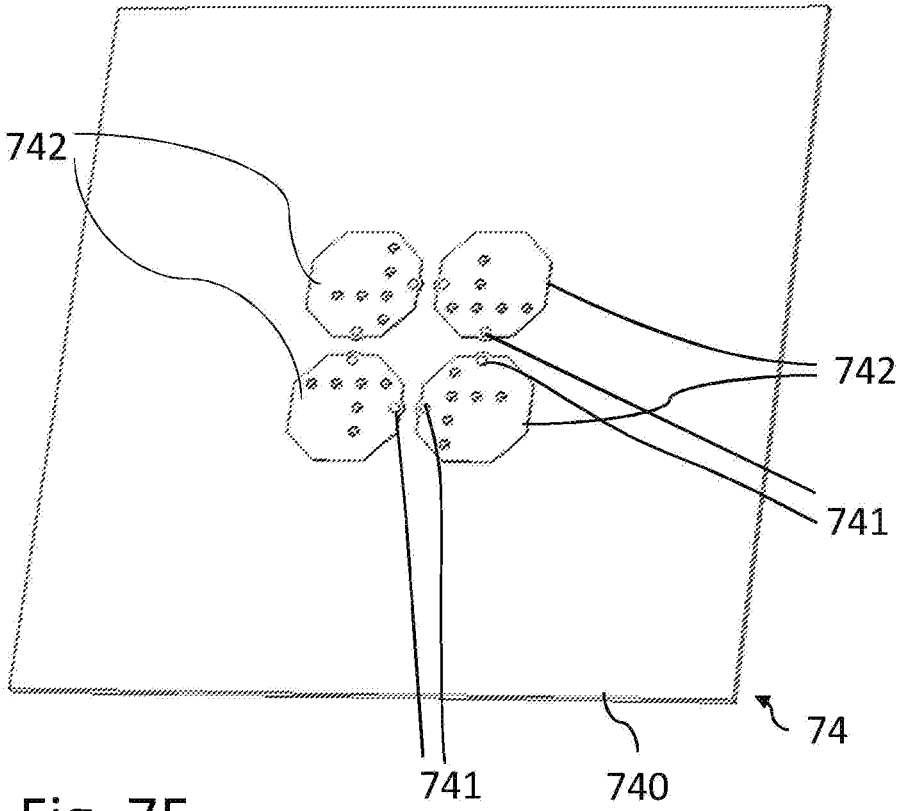
FIG. 7F shows the fourth layer of the arrangement of FIG. 7.
Figure 7G:
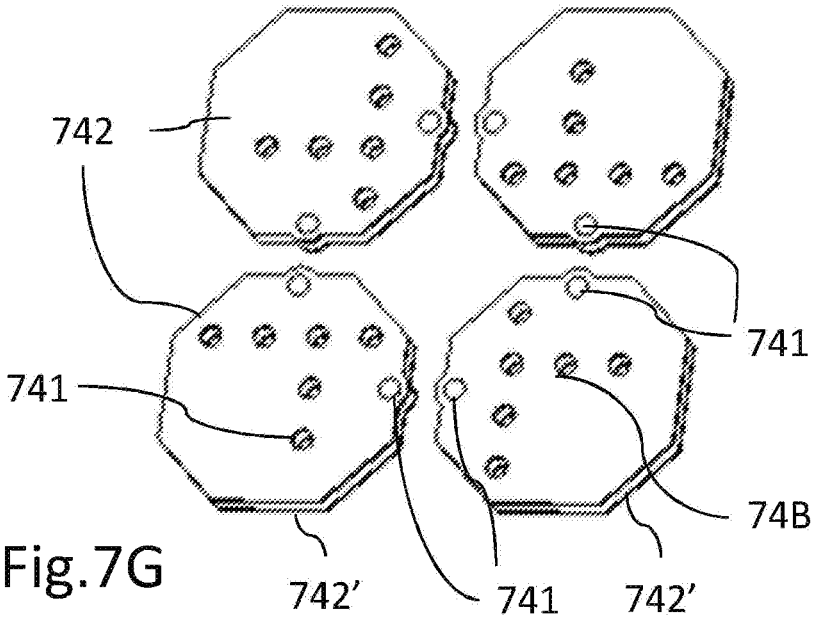
FIG. 7G shows the fourth layer of FIG. 7F with the substrate removed, FIG. 7H schematically illustrates bonding between the first and the fourth layers of the arrangement of FIG. 7.

FIG. 7F shows the fourth layer 74 which comprises a substrate 740, four bowtie arm sections 742, via holes 74B for connecting the bowtie arm sections 742 with corresponding bowtie arm sections 742' arranged on the opposite, lower, side of the substrate 740; cf. FIG. 7G, and via holes 741 for through going feeding vias 744 (see FIG. 7I) going through to the first layer 71. There may also be more through going vias than shown in order to further enhance the performance.

FIG. 7G illustrates the four bowtie arm sections 742 and the bowtie arm sections 742' of the fourth layer 74 with the substrate 740 hidden, the via holes 74B for interconnecting the bowtie arm sections 742 with the respective corresponding bowtie arm sections 742', and the via holes 741 for through going vias more clearly.

Figure 7H:
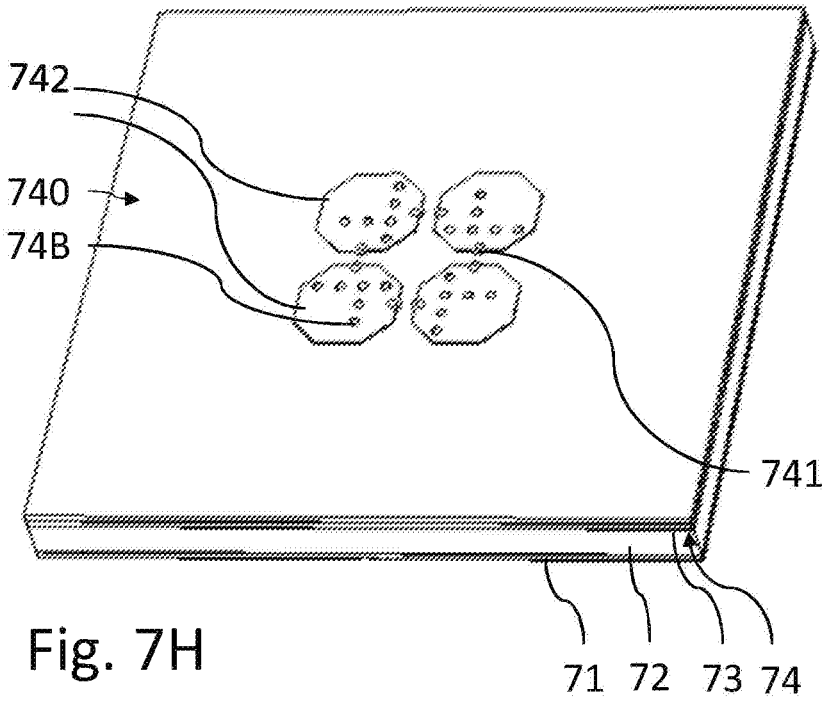
FIG. 7I illustrates bonding between the first and fourth layers as in FIG. 6H but with all substrates removed.

FIG. 7H is a view in perspective schematically illustrating the bonding of the fourth layer 74 with the first layer 71, also indicating the through going via holes 741 and the layer via holes 74B connecting the upper arm sections 742 of the fourth layer 74 with the corresponding arm sections (not seen in FIG. 7H) on the opposite side of the substrate 740 of the fourth layer 74.

Figure 7I:
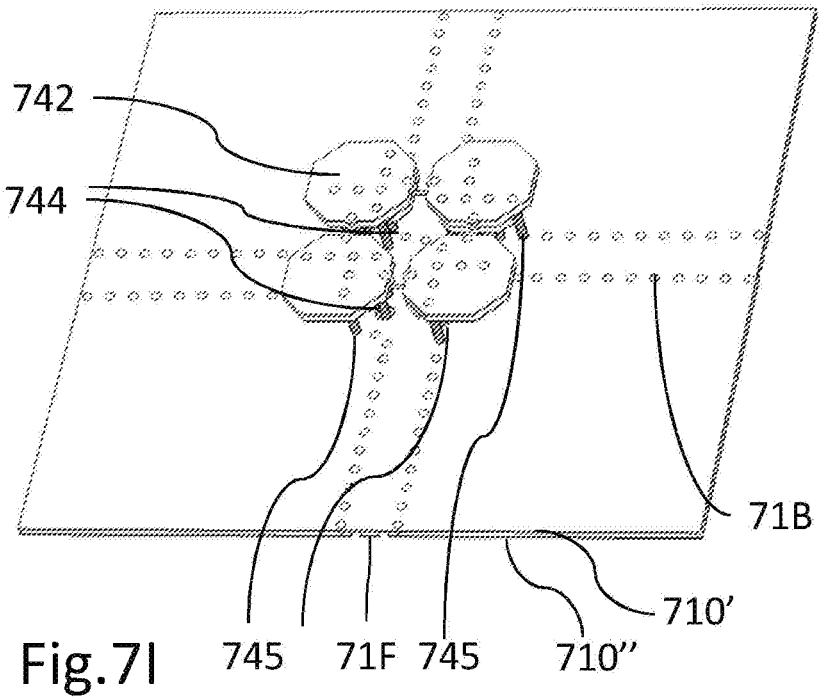

FIG. 7I is a view in perspective schematically illustrating the bonding of the fourth layer 74 with the first layer 71 similar to FIG. 7H but with all substrates hidden in order to more clearly illustrate the geometry. The same reference numerals are used as in FIGS. 7-7H, and elements already described will therefore not be further discussed. The through going feeding vias 744 are illustrated as well as additional vias 745 which are optional and preferably used to further enhance the performance.

Thus, through bonding the fifth layer 75 comprising a substrate with four conducting, e.g. of metal, or metallized, caps 4G (see FIG. 7) to the sub-bonded layer structure comprising layers 71-74, a multi-layer capped bowtie antenna arrangement 160 is provided.

Figure 8:
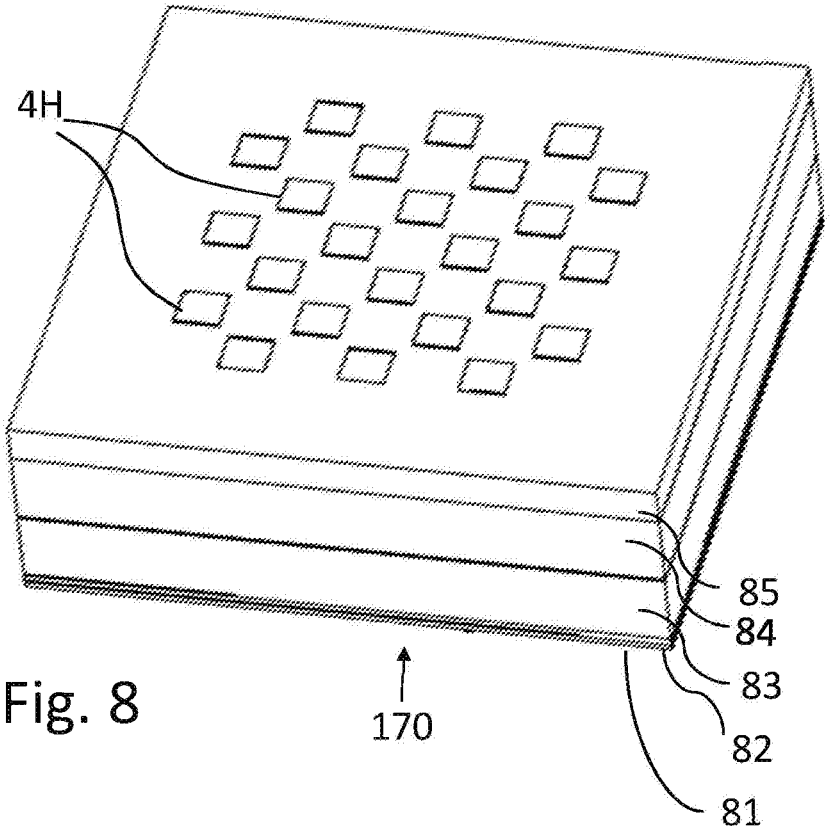
FIG. 8 is a view in perspective of still another embodiment of a bowtie antenna arrangement suitable for mm-wave applications.

FIG. 8 shows yet another embodiment of a bowtie antenna arrangement 170 comprising a multilayered capped bowtie antenna structure particularly suitable for millimeter wave applications. It here comprises a multiple PCB structure comprising a 4×4 array. The multilayer PCB-structure comprises five layers, a first, bottom, layer 81, a second layer 82, a third layer 83, a fourth layer 84 and a fifth layer 85 on which twenty-four caps 4H are disposed.

Figure 8A:
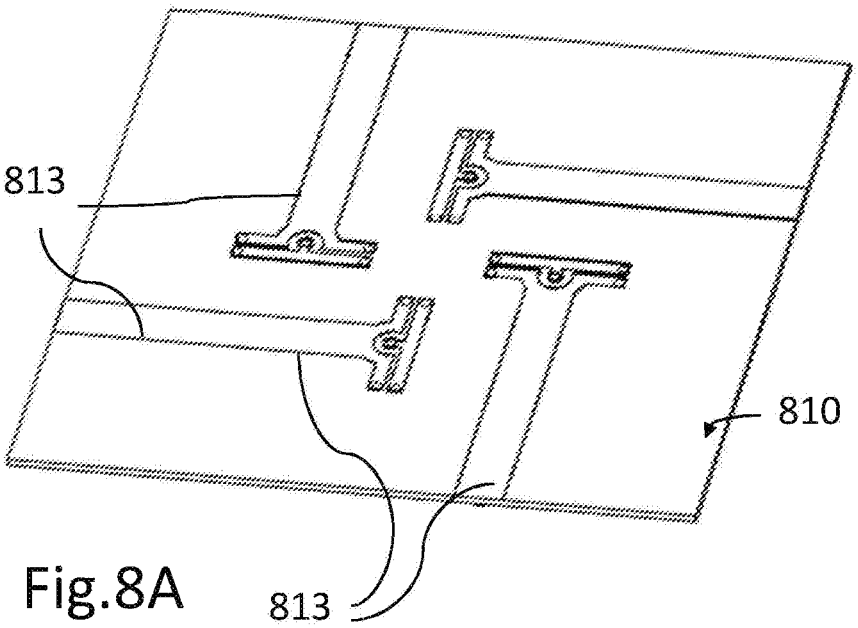
FIG. 8A shows an upper side of a first layer of the arrangement shown in FIG. 8.

The first layer 81 comprises a metal sheet and FIG. 8A shows the upper side 810 of the first layer 81 comprising four metal strips 813 for feeding microstrip lines arranged on the backside of said first layer 81.

Figure 8B:
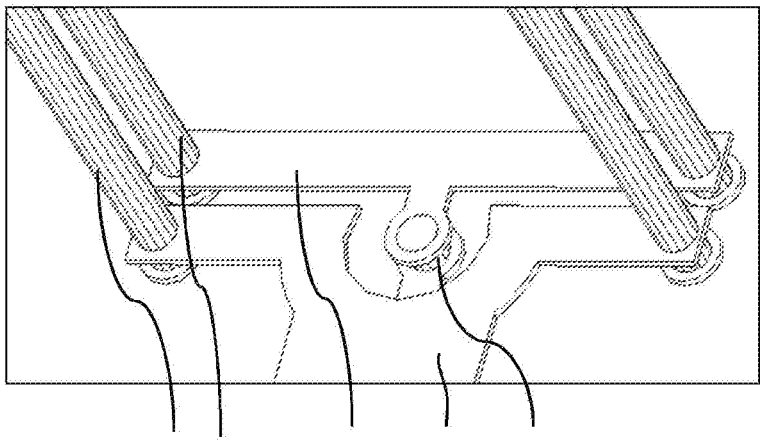
FIG. 8B is an enlarged view of part of the upper side of the first layer shown in FIG. 8A.
Figure 8C:
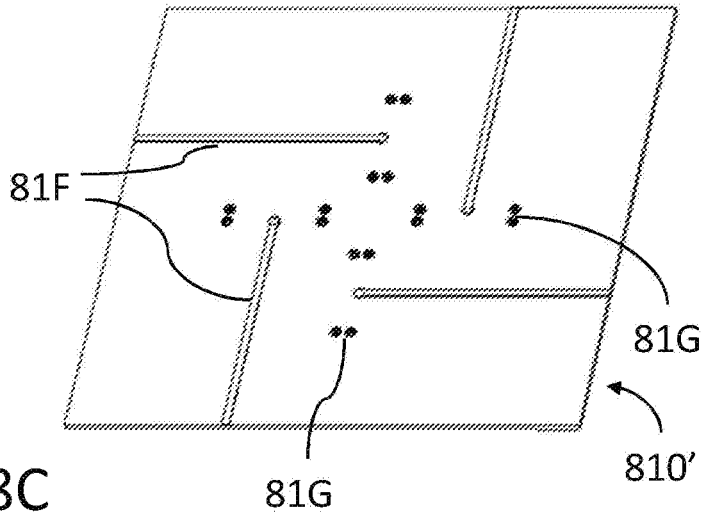
FIG. 8C shows a lower side of the first layer of the arrangement in FIG. 8.
Figure 8D:
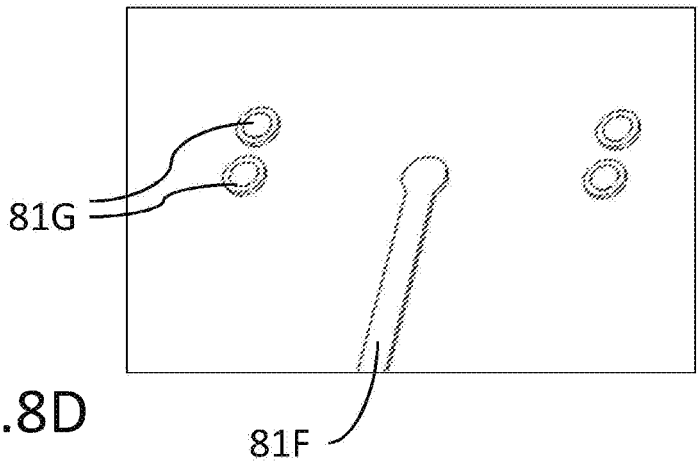
FIG. 8D is an enlarged view of part of the lower side of the first layer shown in FIG. 8C.

FIG. 8B is an enlarged view showing a part of the upper side 810 of the first layer 81 illustrating through going vias 844 comprising metal vias connecting the first layer 81 and the fourth layer 84 for feeding bowtie arm sections 842 (see FIGS. 8I,8J and description with reference to the preceding embodiments), a T-power hybrid 81E for performing a power division with −3 dB (equal power division) and 180° differential feeding of the two through going vias at each end of the T-power hybrid 81E. A metal via 81D is used for connecting the corresponding feeding microstrip line 81F (see FIG. 8C) on the back side 810' of the first layer 81 to the T-power hybrid. FIG. 8C shows the lower, back, side 810' of the first layer 81 with, here, four, input microstrip lines 81F comprising metal lines and via pads 81G for through going vias 844. FIG. 8D is an enlarged view of a part of the lower side 810' of the first layer 81 illustrating a microstrip line 81F and corresponding via pads 81G more clearly.

Figure 8E:
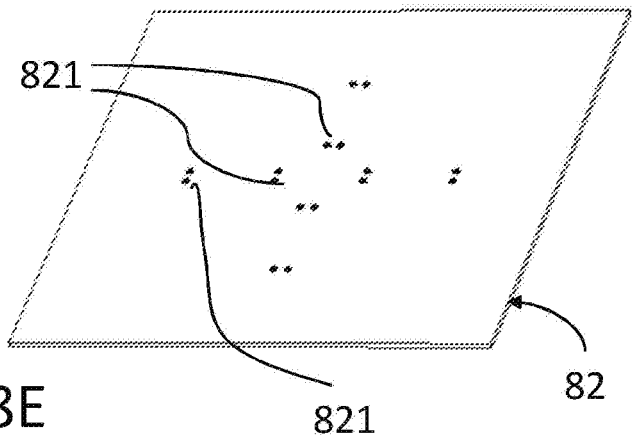
FIG. 8E shows an example of a second layer of an arrangement as in FIG. 8.

FIG. 8E shows the second layer 82 of the bowtie antenna arrangement 170. The second layer 82 comprises a substrate layer or plate with via holes 821 for through going vias 844.

Figure 8F:
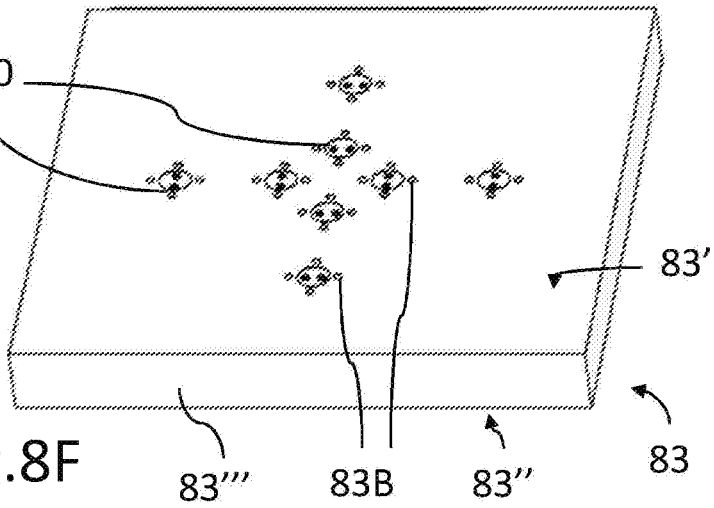
FIG. 8F shows the third layer of the arrangement of FIG. 8.

FIG. 8F shows the third layer 83 of the bowtie antenna arrangement 170. It comprises a substrate 83'" with a metal sheet 83' on the upper (here) side and a metal sheet 83" on the other side of the substrate. The upper metal sheet 83' comprises via holes 830 (see FIG. 8G) for through going vias 844 and via holes 83B for interconnecting the upper and the lower metal sheets 83',83" of the third layer 83.

Figure 8G:
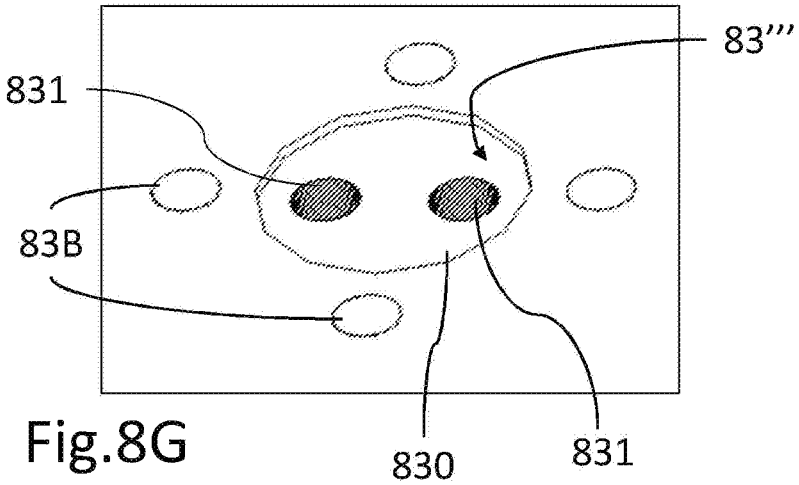
FIG. 8G is an enlarged view of part of the upper side of the third layer shown in FIG. 8F.

FIG. 8G is an enlarged view showing more in detail a part of the upper metal sheet 83' of the third layer 83 illustrating a hole 830 in the upper sheet 83', via holes 83B for interconnection of the upper and lower metal sheets 83',83" and via holes 831 in the substrate 83'" for through going vias 844 (not shown).

Figure 8H:
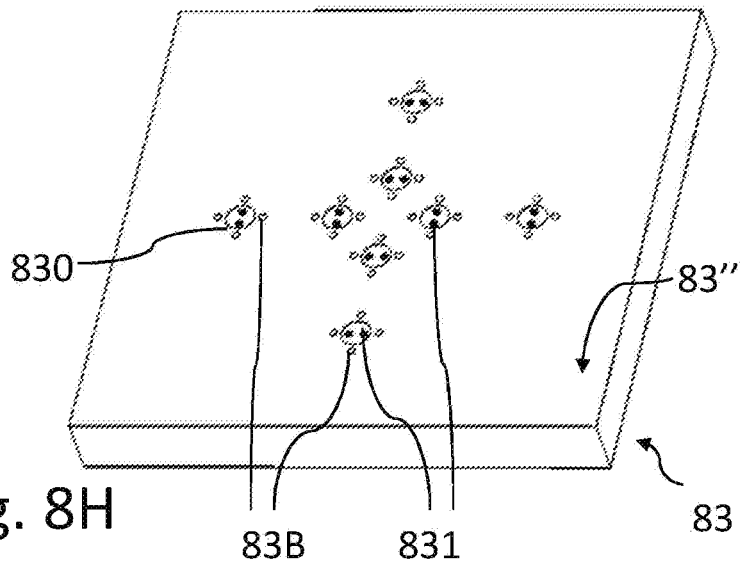
FIG. 8H illustrates the lower part of the third layer shown in FIG. 8F.

FIG. 8H shows the backside 83", or the lower side, of the third layer 83. It is similar to the upper sheet 83' and comprises via holes 830 for through going vias and via holes for interconnection with said upper sheet 83'.

Figure 8I:
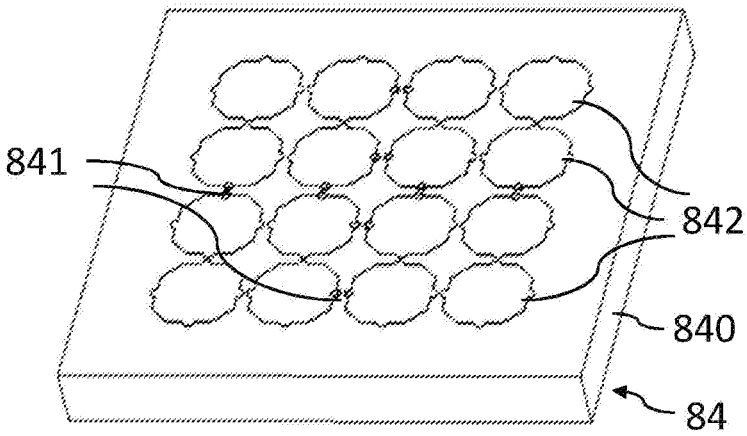
FIG. 8I shows the fourth layer of the arrangement of FIG. 8, and FIG. 8J schematically illustrates the arrangement of FIG. 8 with all substrates removed.

FIG. 8I illustrates the fourth layer 84 comprising a substrate 840 on which a plurality of conducting, e.g. of metal, bowtie arm sections 842 are arranged and via holes 841 for feeding through vias 844 (see FIG. 8J) going through to the first layer 81. There may also be more through going vias than shown in order to further enhance the performance.

Figure 8J:
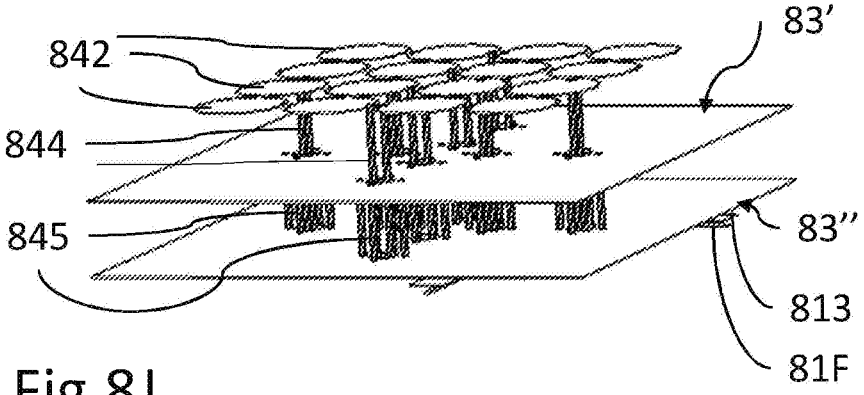

FIG. 8J is a view in perspective schematically illustrating the bonding of the fourth layer 84 with the first layer 81 with all substrates hidden in order to more clearly illustrate the geometry. The same reference numerals are used as in FIGS. 8-8I and elements already described will therefore not be further discussed. The through going feeding vias 844 are illustrated as well as additional vias 845 which are optional and preferably used to further enhance the performance. Thus, through bonding the fifth layer 85 comprising a substrate with, here, twenty-four conducting, e.g. of metal, or metallized, caps 4H (see FIG. 8) to the sub-bonded layer structure comprising layers 81-84, a multi-layer capped bowtie antenna arrangement 170 is provided.

Through the invention it becomes possible to easily fabricate different antenna arrangements having different numbers of ports, ports excited in different desired manners, having different characteristics and being suitable for different applications, e.g. as elements in a Massive MIMO array for 5G communications systems, but of course also for other implementations.

A bowtie antenna arrangement according to the present invention has a large bandwidth, e.g. up to octave bandwidth or even more.

Since the end portions of the bowtie arm sections are separated only a slight distance from each other, there will be only a very weak coupling between the ports which is extremely advantageous for MIMO systems.

It should also be clear that the capped bowtie structures according to the invention can be arranged to form different arrays, different number of ports etc., e.g. suitable for Massive MIMO base station. It should however be clear that it with advantage also can be used for other applications.

Through the use of appropriate electronics, antenna arrays with controllable lobes can be provided which are useable for several, in particular high frequency applications, e.g. in Massive MIMO base stations.

Different mounting elements can be provided for in any appropriate manner in order to allow for easy and reliable mounting of the antenna arrangement wherever desired, for example on the top of a mast, on a wall, at a micro base station etc., or for wall mounting as a wall antenna with approximately a hemi-spherical coverage.

An antenna arrangement may comprise a non-directional antenna arrangement comprising a number of antenna structures mounted on a conducting ground plane or on a PCB.

It is a particular advantage of the invention that antennas with multiple ports are provided which are suitable for MIMO systems, particularly Massive MIMO systems, and which are highly uncoupled (such that variations on channels will be different, avoiding that all channels have a low level at the same time).

It is also particularly an advantage that a MIMO antenna, particularly an antenna that can be used as an element in a Massive MIMO array for 5G, which additionally is very small and compact and can be made in a very cheap and easy manner.

In one application it may comprise a linear array used to feed a parabolic cylinder that e.g. can be used in an OTA (Over-The-Air) test system for wireless communication to vehicles. Then, the linear array in combination with the cylindrical parabolic reflector create a plane wave illuminating the vehicle, e.g. a car.

The invention is not limited to the illustrated embodiments, but can be varied in a number of ways within the scope of the appended claims. Particularly features and elements of different embodiments can be freely varied. Particularly it also covers an antenna system comprising a plurality of antenna arrangements as described above and covered by the claims.

The invention claimed is:

1. A bowtie antenna arrangement comprising at least two bowtie structures, each bowtie structure comprising bowtie arm sections, each bowtie arm section with an end portion facing an end portion of another bowtie arm section to form a respective pair of facing bowtie end portions, the bowtie arm sections being made of an electrically conducting material, a base portion comprising a conducting ground plane or a conducting plane of a Printed Circuit Board, the at least two bowtie structures being connected to a feeding arrangement, wherein:

each bowtie arm section is planar and is made of a conducting sheet or plate element;

the bowtie arm sections are arranged in a bowtie arm section plane located in parallel with, and at a first distance from a first side of the base portion;

the, or each, bowtie arm structure is connected to a feeding port on a second side of the base portion;

in parallel with, and at a second distance from the bowtie arm section plane, a capping arrangement is provided in a cap plane located on a side of the bowtie arm section plane opposite to the side at which the base portion is located, said capping arrangement comprising a plurality of conducting caps, wherein a respective cap of the plurality of conducting caps is located above each pair of facing bowtie end portions of the bowtie structures in a substantially symmetric or centralized manner with respect to the bowtie end portions above which the respective cap is located; and at least one bowtie arm section is reused for, and forms part of, more than one of the at least two bowtie structures, and wherein the end portions of each bowtie arm section forming part of two bowtie structures are substantially perpendicularly located with respect to one another.

2. A bowtie antenna arrangement according to claim 1, wherein the first distance comprising the distance between the bowtie arm section plane and a base plane is about twice the second distance comprising the distance between the bowtie arm section plane and the cap plane.

3. A bowtie antenna arrangement according to claim 1, wherein the first distance comprises about one seventh to one ninth of the wavelength of a low-end operating frequency of the bowtie antenna arrangement.

4. A bowtie antenna arrangement according to claim 1, wherein the second distance comprises about one fifteenth to one seventeenth of the wavelength of a low-end operating frequency of the bowtie antenna arrangement.

5. A bowtie antenna arrangement according to claim 1, wherein each cap of the capping arrangement is arranged to be located substantially symmetrically with respect to two bowtie arm sections above which it is located, at least in a direction of a common line or axis of extension of the bowtie arm sections.

6. A bowtie antenna arrangement according to claim 1, wherein each cap of the capping arrangement comprises a patch of a polygonal shape, or has an elliptic, hyperbolic or circular shape, or any other appropriate regular or irregular shape.

7. A bowtie antenna arrangement according to claim 6, wherein each cap has a size such that a dimension in a direction of a common line or axis of extension of the bowtie arm sections is about one seventh to one ninth of the wavelength of a low-end operating frequency of the bowtie antenna arrangement.

8. A bowtie antenna arrangement according to claim 1, wherein each bowtie arm section is planar and has a polygonal or has an elliptic, hyperbolic or circular shape, or any other appropriate regular or irregular shape.

9. A bowtie antenna arrangement according to claim 1, wherein there is one or more than one feeding port for each bowtie structure.

10. A bowtie antenna arrangement according to claim 1, wherein the arrangement comprises at least three bowtie arm sections and at least one of said bowtie arm sections forms part of two bowtie structures, respective different end portions thereof being located such as to face an end portion of one of the other bowtie arm sections, and a cap is located above each bowtie structure.

11. A bowtie antenna arrangement according to claim 10, wherein all bowtie structures are fed with a same polarization, the bowtie antenna arrangement hence forming a single polarized antenna arrangement.

12. A bowtie antenna arrangement according to claim 10, wherein different bowtie structures are differently excited, fed with different polarizations, at least two feeding ports serving as feeding ports for different polarizations.

13. A bowtie antenna arrangement according to claim 12, wherein the arrangement is a dual polarized antenna arrangement.

14. A bowtie antenna arrangement according to claim 1, wherein the arrangement comprises a planar array antenna arrangement comprising a number of bowtie arm sections forming a number of bowtie structures comprising antenna elements.

15. A bowtie antenna arrangement according to claim 1, wherein the arrangement comprises a supporting arrangement arranged to hold the bowtie arm sections in place at said first distance from the base portion.

16. A bowtie antenna arrangement according to claim 15, wherein the supporting arrangement comprises a mechanical supporting arrangement comprising one or more posts or boxes.

17. A bowtie antenna arrangement according to claim 15, wherein the supporting arrangement is common for each bowtie arm section of a bowtie structure or for a plurality, or all bowtie structures if the antenna arrangement comprises more than one bowtie structure, or the supporting arrangement comprises separate supporting elements for each bowtie arm section, and/or for each bowtie structure.

18. A bowtie antenna arrangement according to claim 15, wherein the supporting arrangement further is arranged to support the capping arrangement at said second distance from the bowtie arm sections, and the supporting arrangement hence is arranged to act as a common support for at least one arm section and at least one cap.

19. A bowtie antenna arrangement according to claim 15, wherein the supporting arrangement further comprises a cap supporting arrangement which is arranged to support the cap or a number of caps, or a separate cap supporting arrangement is provided for each of a number of caps.

20. A bowtie antenna arrangement according to claim 1, wherein the feeding arrangement comprises a number of coaxial connectors for feeding the, or each, bowtie structure.

21. A bowtie antenna arrangement according to claim 20, wherein for each bowtie structure, the feeding arrangement comprises an inner conductor of a respective coaxial connector, a conductor post being provided for each inner conductor, each of which being arranged in said conductor post, a base plane comprises a ground plane provided with a hole for each coaxial connector, allowing the coaxial connector to be disposed on a side of the ground plane opposite to the side at which the bowtie arm sections are located, the or each inner conductor being connected to an end portion of a bowtie arm section of a bowtie structure, a conducting support element being provided between the ground plane and the end portion of the facing bowtie arm section of the bowtie structure, said conducting support element acting as a ground plane for the inner conductor.

22. A bowtie antenna arrangement according to claim 20, wherein the feeding arrangement comprises a microstrip line arranged on a substrate board, a base plane base plane comprises a ground plane provided with a hole for the, or each, coaxial connector, allowing the coaxial connector to be disposed on a side of the ground plane opposite to the side at which the bowtie arm sections are located, the microstrip line being connected to an end portion of a bowtie arm section of the bowtie structure, and the inner conductor of the coaxial connector being connected to the microstrip line, a conducting support element being provided between the ground plane and the end portion of the other bowtie arm section, said conducting support element acting as a ground plane for the inner conductor, and the substrate board is located adjacent, and in parallel with, a metal support element, or formed in one piece with, or is associated therewith.

23. A bowtie antenna arrangement according to claim 21, wherein a metal support element is formed in one piece with a bowtie arm section, and the metal support element is adapted for fastening to the ground plane.

24. A bowtie antenna arrangement according to claim 1, wherein the arrangement is adapted to be used for microwaves or for frequencies up to at least about 30 GHz.

25. A bowtie antenna arrangement according to claim 1, wherein a base plane comprises a bottom metal layer of a PCB comprising a plurality of layers also forming a supporting arrangement, and of which an upper layer comprises a substrate with the respective conducting cap for each bowtie structure, said upper layer being bonded to a sub-bonded structure formed by the others of said layers, feeding via holes being provided which go through the layers of the sub-bonded structure to the upper layer for receiving feeding vias going through from the base plane to a bowtie arm section plane layer disposed below the upper layer with the cap or caps and comprising a number of bowtie arm sections, hence forming a multi-layered capped bowtie antenna arrangement.

26. A bowtie antenna arrangement according to claim 25, wherein the arrangement is adapted to be used for millimeter waves or for frequencies above about 30 GHz.

27. A bowtie antenna arrangement according to claim 1, wherein the arrangement is an ultra-wideband antenna arrangement.

28. A bowtie antenna arrangement according to claim 1, wherein the arrangement is adapted for use in wireless systems with MIMO technology.

* * * * *